US009612567B2

(12) United States Patent
Oi et al.

(10) Patent No.: US 9,612,567 B2
(45) Date of Patent: Apr. 4, 2017

(54) IMAGE FORMING APPARATUS THAT EMITS STATIC ELIMINATING LIGHT ONTO SURFACE OF PHOTOSENSITIVE BODY

(71) Applicant: KYOCERA Document Solutions Inc., Osaka (JP)

(72) Inventors: Hironobu Oi, Osaka (JP); Hisayuki Tachibana, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/079,365

(22) Filed: Mar. 24, 2016

(65) Prior Publication Data

US 2016/0282752 A1 Sep. 29, 2016

(30) Foreign Application Priority Data

Mar. 27, 2015 (JP) ..... 2015-066923
Mar. 27, 2015 (JP) ..... 2015-066924

(51) Int. Cl.
*G03G 21/00* (2006.01)
*G03G 21/08* (2006.01)

(52) U.S. Cl.
CPC ..... *G03G 21/08* (2013.01); *G03G 2215/0132* (2013.01)

(58) Field of Classification Search
CPC .... G03G 21/0094; G03G 21/06; G03G 21/08; G03G 2215/0448; G03G 2215/0451; G03G 2215/0453; G03G 2215/0456; G03G 2215/0458
USPC ..... 399/128
See application file for complete search history.

(56) References Cited

U.S. PATENT DOCUMENTS

| | | | | |
|---|---|---|---|---|
| 9,329,518 | B2 * | 5/2016 | Saito | G03G 15/0136 |
| 9,405,262 | B2 * | 8/2016 | Oi | G03G 21/08 |
| 9,423,725 | B2 * | 8/2016 | Yamauchi | G03G 15/1605 |
| 2008/0193163 | A1 * | 8/2008 | Moon | G03G 21/08 399/128 |

(Continued)

FOREIGN PATENT DOCUMENTS

| | | | |
|---|---|---|---|
| JP | 05061389 | A * | 3/1993 |
| JP | 2002251046 | A * | 9/2002 |
| JP | 2007-219250 | A | 8/2007 |

*Primary Examiner* — Robert Beatty
(74) *Attorney, Agent, or Firm* — IP Business Solutions, LLC

(57) ABSTRACT

An image forming apparatus includes a plurality of photosensitive bodies, a plurality of illumination units respectively opposed to the plurality of photosensitive bodies, and each configured to emit static eliminating light onto a surface of the corresponding photosensitive body, a light emitter that serves as light source, a light guide unit that guides light from the light emitter toward the plurality of illumination units, a driving mechanism that switches between allowing the illumination unit to emit light and restricting the illumination unit from emitting light, to the photosensitive body, and a control unit that causes the driving mechanism to allow the illumination unit opposed to the photosensitive body being used for image forming to emit light to the photosensitive body, and restrict the illumination unit opposed to the photosensitive body not being used for the image forming from emitting light to the photosensitive body.

11 Claims, 18 Drawing Sheets

(56) References Cited

U.S. PATENT DOCUMENTS

2013/0136499 A1* 5/2013 Kamiyama ..... G03G 21/08
399/128

* cited by examiner

IMAGE FORMING APPARATUS THAT EMITS STATIC ELIMINATING LIGHT ONTO SURFACE OF PHOTOSENSITIVE BODY

INCORPORATION BY REFERENCE

This application claims priority to Japanese Patent Application No. 2015-66923 filed on Mar. 27, 2015, and Japanese Patent Application No. 2015-66924 filed on Mar. 27, 2015, the entire contents of which are incorporated by reference herein.

BACKGROUND

The present disclosure relates to an image forming apparatus, and more particularly to a technique of eliminating static electricity from the surface of a photosensitive body by emitting light thereto.

Image forming apparatuses based on a Xerography method are widely known. The method includes five processes, namely uniformly charging an uncharged photosensitive body (charging process), irradiating the surface of the charged photosensitive body with a laser beam according to a document to be copied thereby forming a latent image of the document (exposure process), visualizing the latent image with a toner (developing process), transferring the visualized toner image onto a sheet (transfer process), and fixing the transferred toner image onto the sheet (fixing process).

In the image forming apparatus that adopts the mentioned process, irregularity of potential before the charging process may create a residual image called ghost, in the formed image. The irregularity of the potential on the surface of the photosensitive body is primarily provoked by a residual charge remaining after the image forming process, and therefore, as a remedy, the static electricity is eliminated from the surface of the photosensitive body, after the transfer process or before the charging process. For example, an illumination unit connected to a light source such as a light emitting diode (LED) is provided so as to oppose the photosensitive body.

Further, in most cases the image forming apparatus includes a plurality of photosensitive bodies, not just one, respectively corresponding to a plurality of colors (for example, black, yellow, cyan, and magenta). Accordingly, the illumination unit has to be provided for each of the photosensitive bodies.

The light source also has to be provided for each of the illumination units. Therefore, when the image forming apparatus includes a plurality of photosensitive bodies, the same number of as light sources and connectors for the respective light sources as that of the photosensitive bodies are required. Thus, a larger space is required for the light sources and the connectors therefor, which is contradictory to the requirement for reduction in size of the apparatus, and the manufacturing cost inevitably becomes higher.

As a solution thereto, for example, a technique of eliminating static electricity from the photosensitive bodies has been proposed that includes employing a single piece of light source, instead of preparing the light source for each of the illumination units.

SUMMARY

Accordingly, the disclosure proposes further improvement of the foregoing technique.

In an aspect, the disclosure provides an image forming apparatus including a plurality of photosensitive bodies, a plurality of illumination units, a light emitter, a light guide unit, a driving mechanism, and a control unit.

The illumination units are respectively opposed to the plurality of photosensitive bodies, and each emit static eliminating light onto a surface of the corresponding photosensitive body.

The light emitter serves as a light source.

The light guide unit guides light from the light emitter toward the plurality of illumination units.

The driving mechanism is configured to switch between allowing the illumination unit to emit light and restricting the illumination unit from emitting light, to the photosensitive body.

The control unit is configured to cause the driving mechanism to allow the illumination unit opposed to the photosensitive body being used for image forming to emit light to the photosensitive body, and to restrict the illumination unit opposed to the photosensitive body not being used for the image forming from emitting light to the photosensitive body.

DETAILED DESCRIPTION

Figure 1:
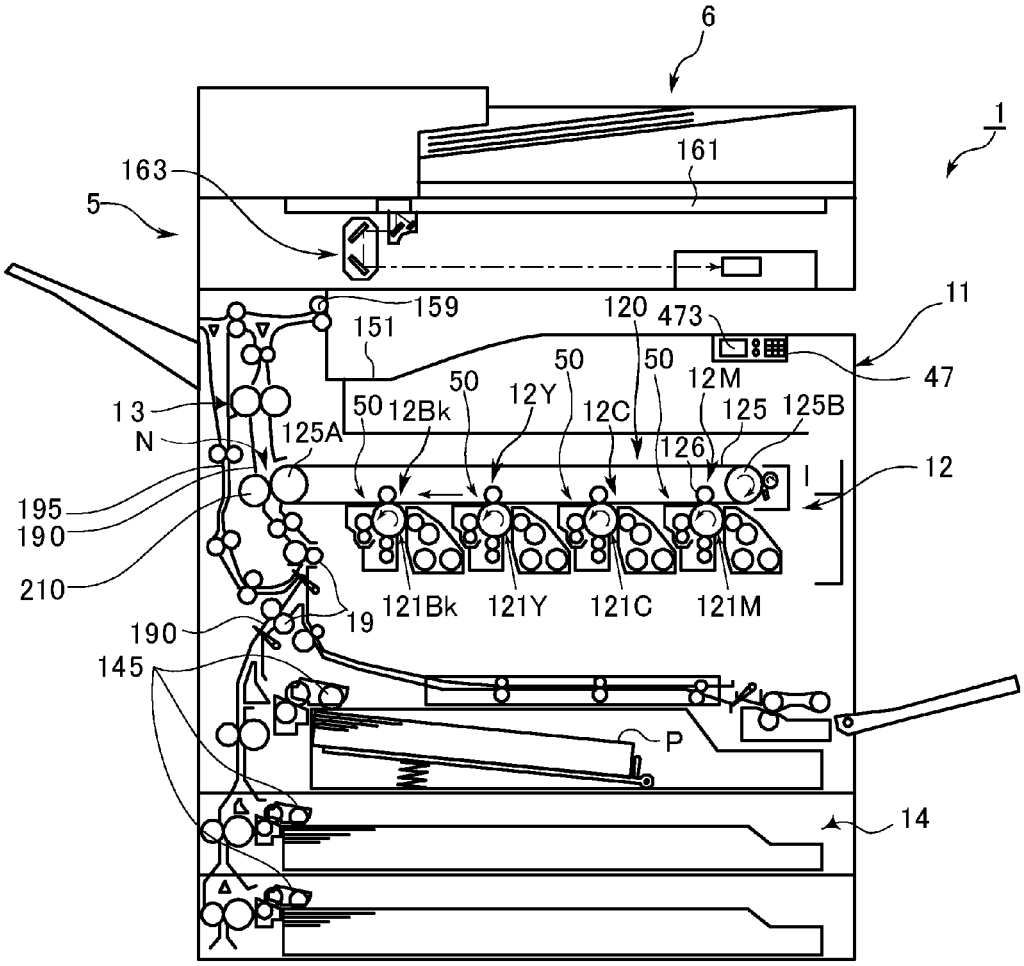
FIG. 1 is a partially cut away front view showing a configuration of an image forming apparatus according to a first embodiment of the disclosure.

Hereafter, embodiments of the image forming apparatus according to the disclosure will be described with reference to the drawings. FIG. 1 is a partially cut away front view showing a configuration of the image forming apparatus according to a first embodiment of the disclosure.

The image forming apparatus 1 according to the first embodiment of the disclosure is a multifunction peripheral having a plurality of functions, such as copying, printing, scanning, and facsimile transmission. The image forming apparatus 1 includes an operation unit 47, a display unit 473, a document feeder 6, and a document reader 5, which are mounted inside a main body 11.

In the image forming apparatus 1, a document reading operation is performed as follows. The document reader 5 including a reading mechanism 163 optically reads the image on a source document delivered from the document feeder 6 or placed on a platen glass 161, and generates image data.

In the image forming apparatus 1, an image forming operation is performed as follows. An image forming unit 12 forms a toner image on a sheet P serving as a recording medium and delivered from a paper feed unit 14 including a pickup roller 145, on the basis of the image data generated through the document reading operation.

The image forming unit 12 includes an image forming subunit 12Bk for black (Bk), an image forming subunit 12Y for yellow (Y), an image forming subunit 12C for cyan (C), and an image forming subunit 12M for magenta (M). The image forming subunits 12Bk, 12Y, 12C, and 12M respectively include drum-shaped photosensitive bodies 121Bk, 121Y, 121C, and 121M, which are configured to rotate counterclockwise in FIG. 1. Here, the drum-shaped photosensitive bodies 121Bk, 121Y, 121C, and 121M exemplify the photosensitive bodies in the disclosure.

The image forming unit 12 also includes a transfer unit 120, including an intermediate transfer belt 125, on an outer circumferential surface of which the toner image is transferred, a drive roller 125A, a slave roller 125B, and a primary transfer roller 126.

Hereunder, a color printing operation will be described. The respective circumferential surfaces of the photosensitive bodies 121Bk, 121Y, 121C, and 121M are uniformly charged (charging process), the surfaces of the photosensitive bodies 121Bk, 121Y, 121C, and 121M which have been charged are irradiated with a laser beam according to the image data, to form the latent image (exposure process), the latent image is visualized with a toner (developing process), and then the toner image formed by the visualization is transferred onto the intermediate transfer belt 125, via the primary transfer roller 126.

The toner images of the respective colors (black, yellow, cyan and magenta) to be transferred onto the intermediate transfer belt 125 are superposed at an adjusted timing on the intermediate transfer belt 125, so as to form a colored toner image.

A secondary transfer roller 210 transfers the colored toner image formed on the surface of the intermediate transfer belt 125 onto the sheet P transported along a transport route 190 from the paper feed unit 14, at a nip region N of a drive roller 125A engaged with the intermediate transfer belt 125. Here, the description thus far given refers to the color printing. In the case of monochrome printing, only the photosensitive body 121Bk for black is employed, without using the photosensitive bodies 121Y, 121C, and 121M for yellow, cyan, and magenta.

The image forming unit 12 is also configured to move the intermediate transfer belt 125 away from the photosensitive bodies 121Y, 121C, and 121M for yellow, cyan, and magenta (separation function for excluding three colors) when monochrome printing is performed. Accordingly, the service life of the components constituting the image forming subunits 12Y, 12C, 12M for color printing can be prolonged.

A fixing unit 13 serves to fix the toner image on the sheet P by thermocompression, and the sheet P that has undergone the fixing process, now having the color image formed thereon, is outputted to an output tray 151.

The photosensitive bodies 121Bk, 121Y, 121C, and 121M each include a static elimination unit 50 that removes the residual electric charge, by irradiating the surface of the photosensitive bodies 121Bk, 121Y, 121C, and 121M with a static eliminating light after the image forming operation performed by the image forming subunits 12Bk, 12Y, 12C, and 12M.

Figure 2:
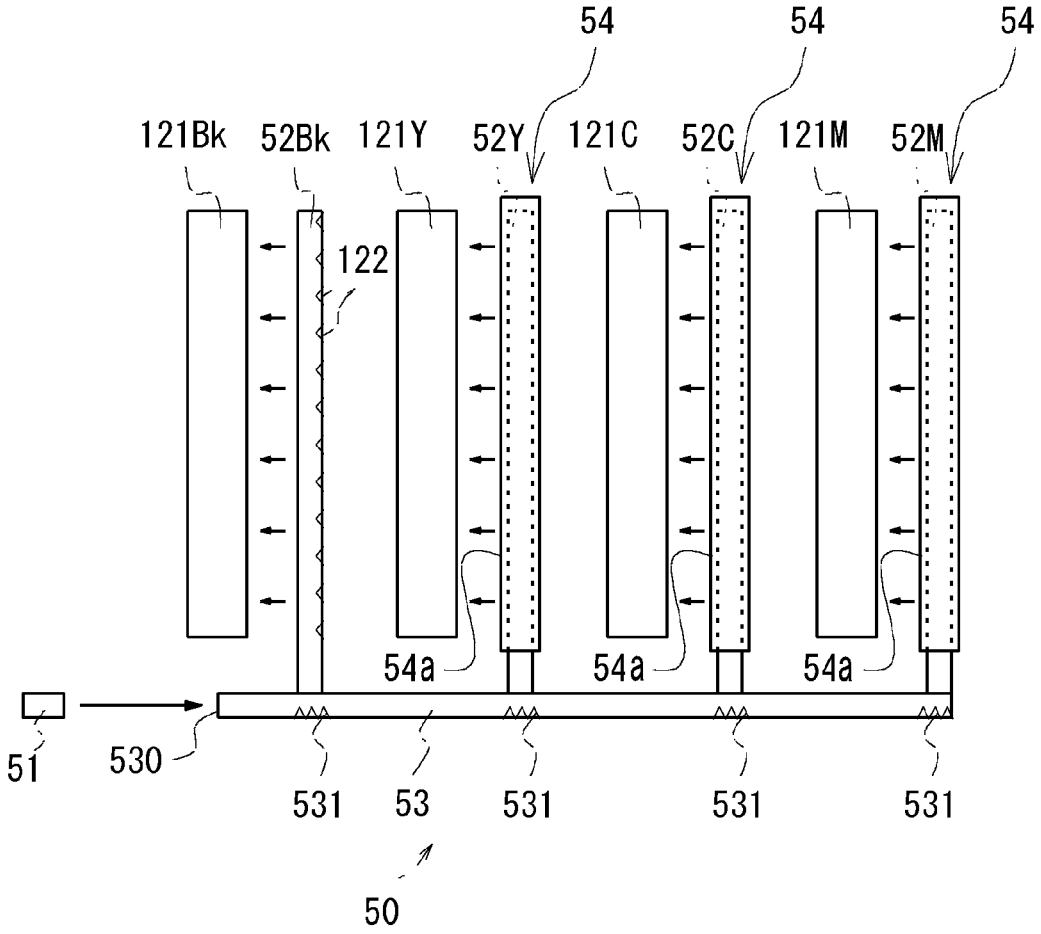
FIG. 2 is a schematic plan view showing a static elimination unit and peripheral components according to the first embodiment of the disclosure.

FIG. 2 is a schematic plan view showing the static elimination unit and peripheral components according to the first embodiment of the disclosure the disclosure. The static elimination unit 50 includes a light emitter 51 serving as light source of the static eliminating light, a plurality of illumination units 52Bk, 52Y, 52C, and 52M that respectively emit light to the drum-shaped photosensitive bodies 121Bk, 121Y, 121C, and 121M, a light guide unit 53 connecting the illumination units 52Bk, 52Y, 52C, and 52M so as to guide the light from the light emitter 51 to the illumination units 52Bk, 52Y, 52C, and 52M, and shielding members 54 respectively covering the illumination units 52Y, 52C, and 52M. Here, the light emitter 51, the illumination units 52Bk, 52Y, 52C, and 52M, the light guide unit 53, and the shielding members 54 exemplify the light emitter, the illumination units, the light guide unit, and the shielding member in the disclosure, respectively.

The light guide unit 53 is disposed so as to extend in a direction orthogonal to the longitudinal direction of the photosensitive bodies 121Bk, 121Y, 121C, and 121M, and includes a light entrance 530 of a protruding shape provided at an end portion so as to oppose the light emitter 51, to introduce the light from the light emitter 51 into the light guide unit 53.

The illumination units 52Bk, 52Y, 52C, and 52M, formed in a rod shape, are respectively opposed to the drum-shaped photosensitive bodies 121Bk, 121Y, 121C, and 121M with a predetermined spacing therebetween, such that the respective axial lines are oriented parallel to each other.

An end portion of each of the illumination units 52Bk, 52Y, 52C, and 52M in the longitudinal direction is connected to the light guide unit 53, so that the light distributed from the light guide unit 53 is emitted onto the illumination units 52Bk, 52Y, 52C, and 52M. Thus, the static eliminating light is emitted to the photosensitive bodies 121Bk, 121Y, 121C, and 121M.

The light guide unit 53 is formed of a light-transmissive resin material such as acrylic, and includes a plurality of reflection patterns 531 including reverse V-shaped prisms and formed on one side of the light guide unit 53 so as to project toward the junction to the illumination units 52Bk, 52Y, 52C, and 52M.

The reflection pattern 531 of the prism shape serves to reflect the light that has entered into the light guide unit 53 through the light entrance 530 in the direction orthogonal to the longitudinal direction of the light guide unit 53, to thereby guide the light toward the illumination units 52Bk, 52Y, 52C, and 52M.

The illumination units 52Bk, 52Y, 52C, and 52M are each formed of a light-transmissive resin material such as acrylic like the light guide unit 53, and include a reflection pattern 122 (only illustrated in illumination unit 52Bk) including reverse V-shaped prisms and formed on the opposite side of the photosensitive bodies 121Bk, 121Y, 121C, and 121M.

The reflection pattern 122 of the prism shape serves to reflect the light that has entered into the illumination unit 52Bk, 52Y, 52C, and 52M from the light guide unit 53 by being reflected by the reflection pattern 531, in the direction orthogonal to the longitudinal direction of the illumination units 52Bk, 52Y, 52C, and 52M (direction toward the photosensitive bodies 121Bk, 121Y, 121C, and 121M), to thereby emit the light onto the photosensitive bodies 121Bk, 121Y, 121C, and 121M.

The shielding members 54 are respectively provided for the photosensitive bodies 121Y, 121C, and 121M for yellow, cyan, and magenta. To be more detailed, the shielding members 54 respectively cover the illumination units 52Y, 52C, and 52M opposed to the photosensitive bodies 121Y, 121C, and 121M, and are configured to rotate about the illumination units 52Y, 52C, and 52M. The shielding members 54 each include a transmission path (a transmission opening) 54*a* formed in a part of the circumferential surface so as to extend in the longitudinal direction, through which the light emitted from the illumination units 52Y, 52C, and 52M can be transmitted toward the photosensitive bodies 121Y, 121C, and 121M. Thus, the shielding members 54 each serve to transmit or block the light proceeding toward the photosensitive bodies 121Y, 121C, and 121M.

Figure 3:
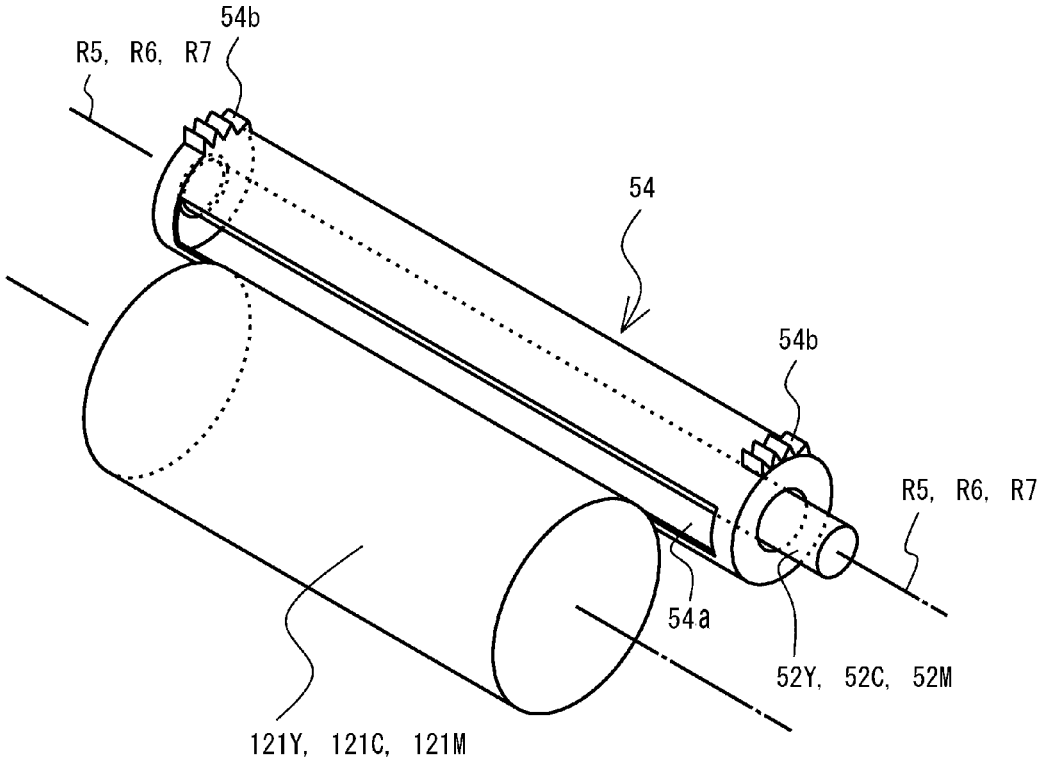
FIG. 3 is a schematic perspective view showing a shielding member and peripheral components according to the first embodiment of the disclosure.

FIG. 3 is a schematic perspective view showing the shielding member and peripheral components according to the first embodiment of the disclosure. The shielding member 54 is disposed to cover one of the illumination units 52Y, 52C, and 52M and includes the transmission path 54*a* of an elongate shape that transmits the light, formed on the outer circumferential surface so as to extend along the rotation axis R5, R6, R7. When the shielding member 54 rotates about the rotation axis R5, R6, R7 the position of the transmission path 54*a* with respect to the photosensitive bodies 121Y, 121C, and 121M is changed, so that the light emitted from the illumination units 52Y, 52C, and 52M is transmitted or blocked. The shielding member 54 also includes a pinion gear 54*b* formed on both end portions in the longitudinal direction, so as to allow the shielding member 54 to rotate about the rotation axis R5, R6, R7 by being meshed with a rack provided on a retainer to be subsequently described.

Figure 4A:
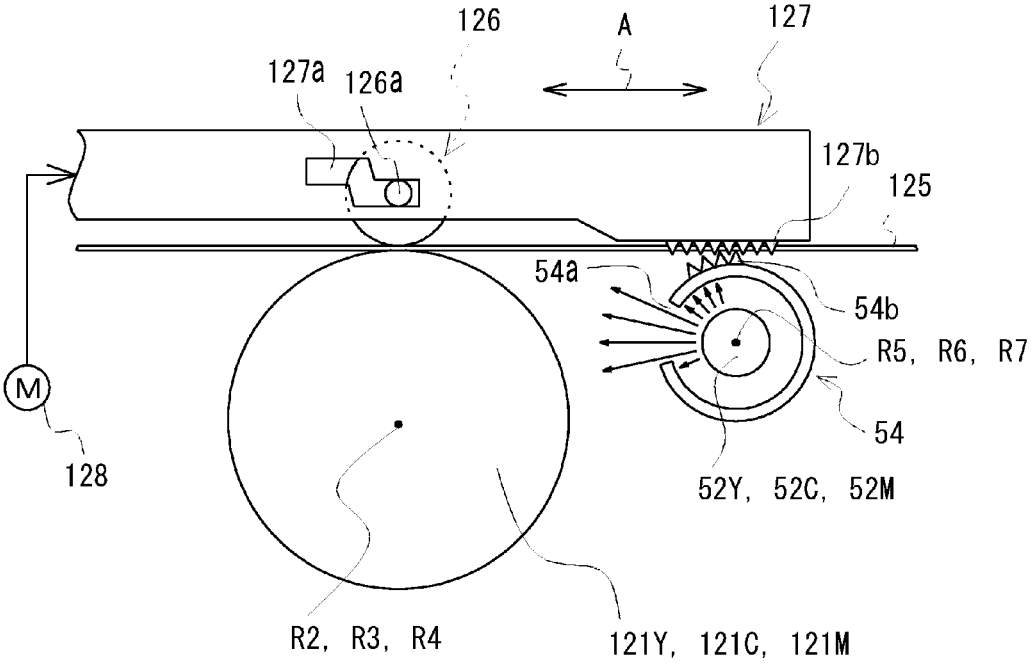
FIG. 4A and FIG. 4B are partially cut away front views showing the shielding member and the peripheral components according to the first embodiment of the disclosure.
Figure 4B:
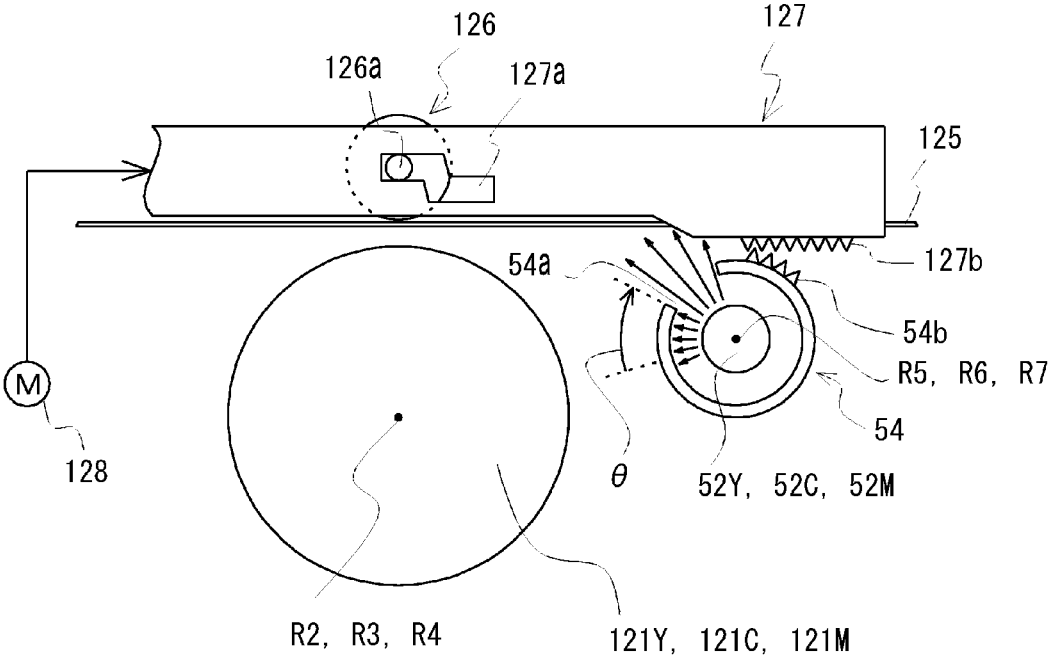

FIG. 4A and FIG. 4B are partially cut away front views showing the shielding member and the peripheral components according to the first embodiment of the disclosure. When the transmission path 54*a* of the shielding member 54 is positioned between the photosensitive bodies 121Y, 121C, and 121M and the corresponding one of the illumination units 52Y, 52C, and 52M as shown in FIG. 4A, the light serving as static eliminating light emitted from the illumination units 52Y, 52C, and 52M can respectively reach the photosensitive bodies 121Y, 121C, and 121M.

The primary transfer roller 126 serves to transfer the toner image onto the intermediate transfer belt 125. The primary transfer roller 126 is supported by the retainer 127, and a rod 126*a* included in the primary transfer roller 126 is slidably engaged with a control slot (a control opening) 127*a* of a Z-shape in a front view formed in the retainer 127. The control slot 127*a* includes a first control region employed for monochrome printing, a second control region employed for color printing, and a third control region for switching between the first control region and the second control region.

The retainer 127 is driven by the electric motor 128 so as to move along a non-illustrated rail in a direction indicated by an arrow A in FIG. 4A. When the retainer 127 moves to the right in FIG. 4A, the rod 126*a* of the primary transfer roller 126 moves to the left inside the control slot 127*a*, and reaches the first control region as shown in FIG. 4B. Therefore, the primary transfer roller 126 moves away from the photosensitive bodies 121Y, 121C, and 121M. The action of the electric motor 128 is controlled by a controller 100 (see FIG. 5) to be subsequently described in details. The retainer 127 and the electric motor 128 exemplify the driving mechanism in the disclosure.

When the primary transfer roller 126 moves away from the photosensitive bodies 121Y, 121C, and 121M, the tension applied to the intermediate transfer belt 125 changes, so that the intermediate transfer belt 125 is lifted up and moves away from the photosensitive bodies 121Y, 121C, and 121M. Conversely, when the retainer 127 moves to the left, the rod 126*a* of the primary transfer roller 126 slides to the right inside the control slot 127*a*, and reaches the second control region as shown in FIG. 4A. Therefore, the primary transfer roller 126 moves toward the photosensitive bodies 121Y, 121C, and 121M, to thereby bring the intermediate transfer belt 125 into contact with the photosensitive bodies 121Y, 121C, and 121M. Here, the rod 126*a* of the primary transfer roller 126, the retainer 127, the control slot 127*a*, and the electric motor 128 exemplify the contact control mechanism in the disclosure.

The retainer 127 includes a rack 127*b* formed on the lower face so as to mesh with the pinion gear 54*b* formed on a part of the outer circumferential surface of the shielding member 54, so that when the retainer 127 moves to the right in FIG. 4A the shielding member 54 rotates clockwise as shown in FIG. 4B. Accordingly, the transmission path 54*a* formed in the shielding member 54 moves upward in FIG. 4B, thus to be displaced from the position between the photosensitive bodies 121Y, 121C, and 121M and the corresponding one of the illumination units 52Y, 52C, and 52M, and therefore the light emitted from the illumination units 52Y, 52C, and 52M is unable to reach the photosensitive bodies 121Y, 121C, and 121M, respectively.

Here, an equation of $2r\pi\ \theta/360=L$ can be established, where r denotes the radius of the shielding member 54, θ denotes the rotation angle of the shielding member 54, and L denotes the distance traveled by the retainer 127. Therefore, when the magnitude of the required rotation angle θ is determined, an appropriate radius r of the shielding member 54 can be obtained.

Figure 5:
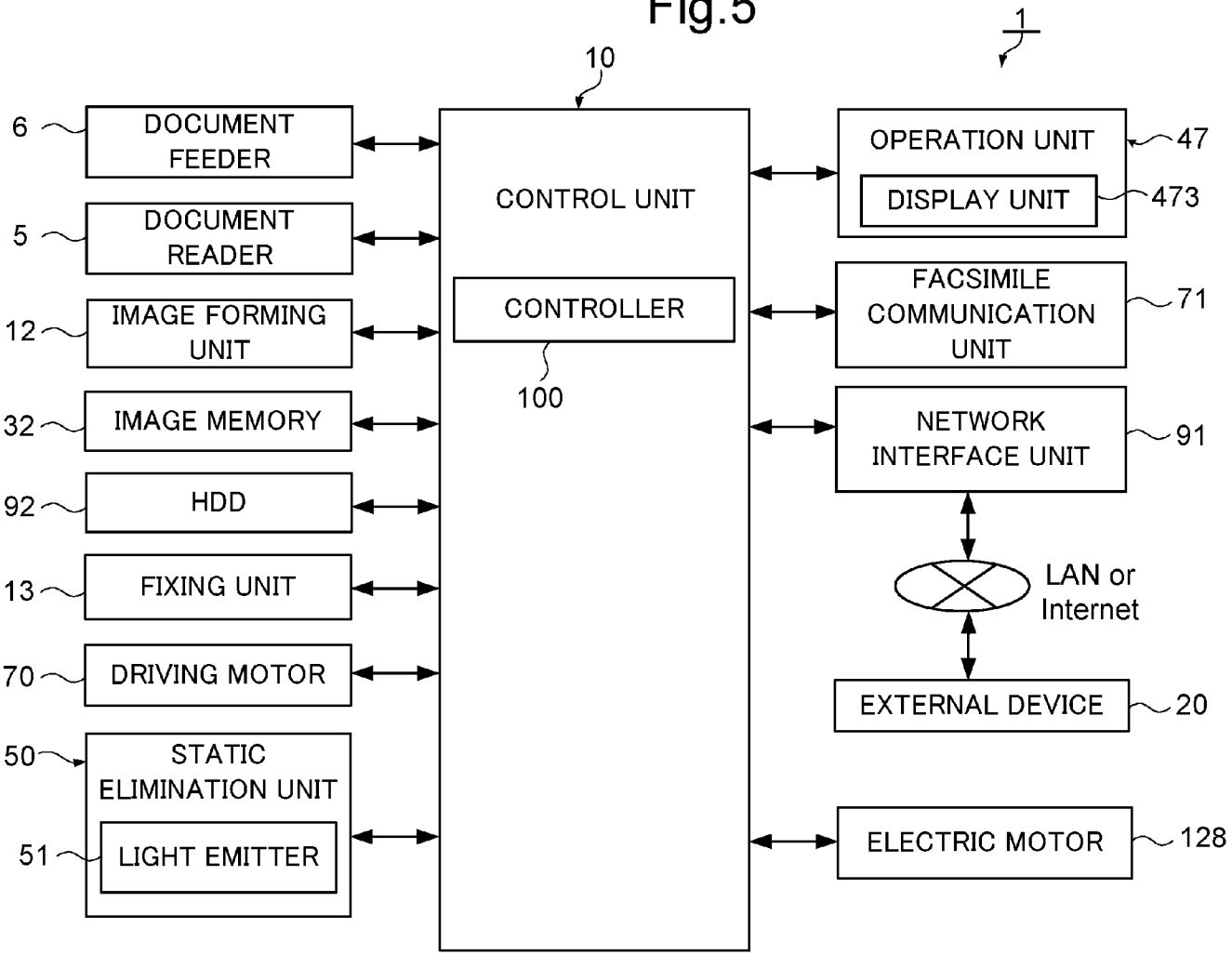
FIG. 5 is a functional block diagram showing an essential part of the internal configuration of the image forming apparatus according to the first embodiment of the disclosure.

FIG. 5 is a functional block diagram showing an essential part of the internal configuration of the image forming apparatus 1. The image forming apparatus 1 includes a control unit 10, the document feeder 6, the document reader 5, the image forming unit 12, an image memory 32, a HDD 92, the fixing unit 13, a driving motor 70, the static elimination unit 50, the operation unit 47, a facsimile communication unit 71, a network interface unit 91, and an electric motor 128. The same constituents as those referred to above included in the image forming apparatus 1 shown in FIG. 1, the static elimination unit 50 and the peripheral components shown in FIG. 2, and the shielding member 54 and the peripheral components shown in FIG. 3 and FIGS. 4A and 4B are given the same numeral, and the description thereof will not be repeated.

The driving motor 70 is a drive source that provides a rotational driving force to the rotational components and the transport roller pair 19 of the image forming unit 12.

The control unit 10 is constituted of exclusive hardware circuits such as a central processing unit (CPU), and includes the controller 100 which is a processor that serves to control the overall operation of the image forming apparatus 1. For example, the controller 100 drives the electric motor 128 so as to control the movement of the retainer 127.

Figure 6:
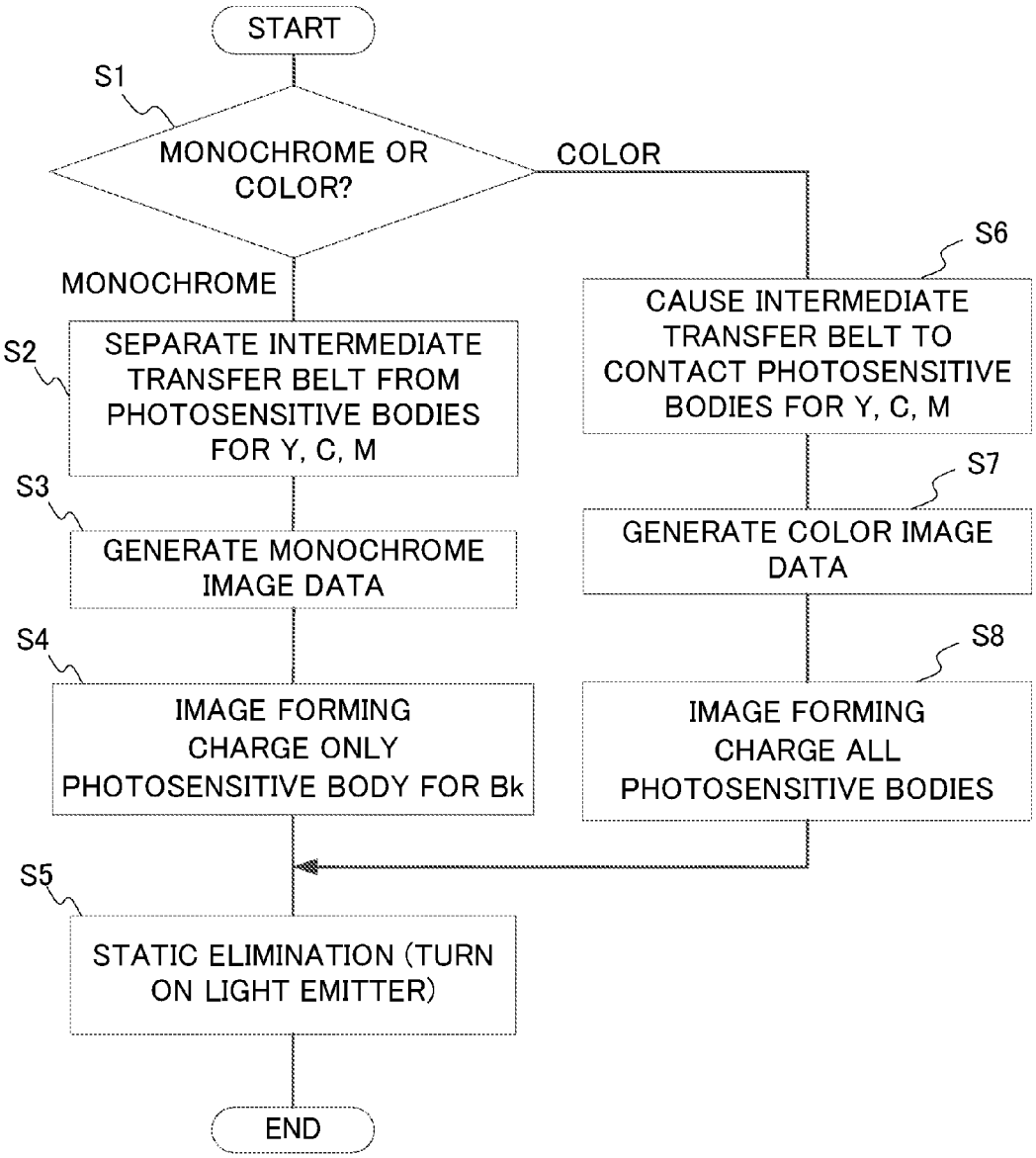
FIG. 6 is a flowchart showing an image forming operatithe on performed by a control unit of the image forming apparatus according to the first embodiment of the disclosure.

Referring now to the flowchart shown in FIG. 6, an example of the image forming operation performed by the controller 100 of the image forming apparatus 1 according to the first embodiment of the disclosure will be described hereunder. The following description of the image forming operation is based on the assumption that a document printing job has been instructed through the operation unit 47.

First, the controller 100 decides whether the image forming job instructed by the user through the operation unit 47 is for monochrome printing or color printing (step S1), and in the case of the monochrome printing ("monochrome" at step S1), the controller 100 controls the electric motor 128 so as to move the retainer 127 in the direction to cause the intermediate transfer belt 125 to move away from the photosensitive bodies 121Y, 121C, and 121M for yellow, cyan, and magenta (step S2). Accordingly, the transmission path 54*a* formed in the shielding member 54 moves upward as shown in FIG. 4B, thus to be displaced from the position between the photosensitive bodies 121Y, 121C, and 121M and the corresponding one of the illumination units 52Y, 52C, and 52M.

Then the controller 100 generates the monochrome image data (step S3), and outputs an instruction signal to the image forming unit 12 to form the monochrome toner image on the sheet P on the basis of the generated image data (step S4). More specifically, the controller 100 controls the image forming subunit 12Bk for black so as to charge the surface of the photosensitive body 121Bk for black (charging process), and then the toner image is formed on the photosensitive body 121Bk through the exposure and developing processes and the toner image thus formed is transferred onto the intermediate transfer belt 125. The toner image is then transferred onto the sheet P in the nip region N, and fixed on the sheet P by thermocompression.

After the image forming operation is finished, the controller 100 turns on the light emitter 51 (step S5). The light from the light emitter 51 reaches the photosensitive body 121Bk through the light guide unit 53 and the illumination unit 52Bk. However, the shielding member 54 is disposed in the position shown in FIG. 4B, where the transmission path 54*a* formed in the shielding member 54 is displaced from the position between the photosensitive bodies 121Y, 121C, and 121M and the corresponding one of the illumination units 52Y, 52C, and 52M, and therefore the light from the light emitter 51 is unable to reach the photosensitive bodies 121Y, 121C, and 121M. Accordingly, although the surface of the photosensitive body 121Bk is irradiated with the static eliminating light, the respective surfaces of the photosensitive bodies 121Y, 121C, and 121M are not irradiated with the static eliminating light.

In contrast, in the case where the controller 100 decides at step S1 that the instruction from the operation unit 47 is for color printing ("color" at step S1), the controller 100 controls the electric motor 128 to drive the retainer 127 so as to bring the intermediate transfer belt 125 into contact with the photosensitive bodies 121Y, 121C, and 121M for yellow, cyan, and magenta (step S6). As result, the transmission path 54*a* formed in the shielding member 54 moves downward as shown in FIG. 4A, to the position between the photosensitive bodies 121Y, 121C, and 121M and the illumination units 52Y, 52C, and 52M, respectively.

Then the controller 100 generates the color image data (step S7), and outputs an instruction signal to the image forming unit 12 to form the color toner image on the sheet P on the basis of the generated image data (step S8). More specifically, the controller 100 controls the image forming subunits 12Bk, 12Y, 12C, and 12M so as to charge the surface of the photosensitive bodies 121Y, 121C, and 121M for yellow, cyan, and magenta, not only the photosensitive body 121Bk for black (charging process), and then the toner image is formed on the photosensitive bodies 121Bk, 121Y, 121C, and 121M through the exposure and developing processes and the toner image thus formed is transferred onto the intermediate transfer belt 125. At this point, the toner images of the respective colors are superposed on the intermediate transfer belt 125 at an adjusted transfer timing. The toner image is then transferred onto the sheet P in the nip region N, and fixed on the sheet P by thermocompression.

After the image forming operation, the controller 100 turns on the light emitter 51 (step S5). The shielding member 54 is disposed in the position shown in FIG. 4A, where the transmission path 54*a* formed in the shielding member 54 is positioned between the photosensitive bodies 121Y, 121C, and 121M and the corresponding one of the illumination units 52Y, 52C, and 52M, and therefore the light from the light emitter 51 can reach the photosensitive bodies 121Y, 121C, and 121M, in addition to the photosensitive body 121Bk.

As described above, the light emitter 51, which is a single independent component, can serve as light source for the illumination units 52Bk, 52Y, 52C, and 52M. In addition, when the monochrome printing is performed, the static eliminating light from the illumination units 52Y, 52C, and 52M is unable to reach the photosensitive bodies 121Y, 121C, and 121M for yellow, cyan, and magenta, which are not used for image forming.

Thus, since the single light emitter 51 serves as light source for the four illumination units 52Bk, 52Y, 52C, and 52M in the first embodiment, the number of light sources can be reduced. In addition, when the monochrome printing is performed the photosensitive bodies 121Y, 121C, and 121M for yellow, cyan, and magenta, which are not used, are not irradiated with the static eliminating light. Therefore, the photosensitive bodies 121Y, 121C, and 121M for yellow, cyan, and magenta are exempted from suffering optical fatigue, despite not being subjected to the driving and charging process like the photosensitive body 121Bk for black. Consequently, the configuration according to this embodiment enables reduction in number of light sources of the static eliminating light, and restricts the static eliminating light from reaching the photosensitive bodies that are not used in the image forming operation, thereby preventing optical fatigue of those unused photosensitive bodies.

Here, although the first embodiment represents the case where the light emitter 51 is turned on to perform the static elimination after the image forming operation is finished, the static elimination may be performed at a different timing.

Figure 7:
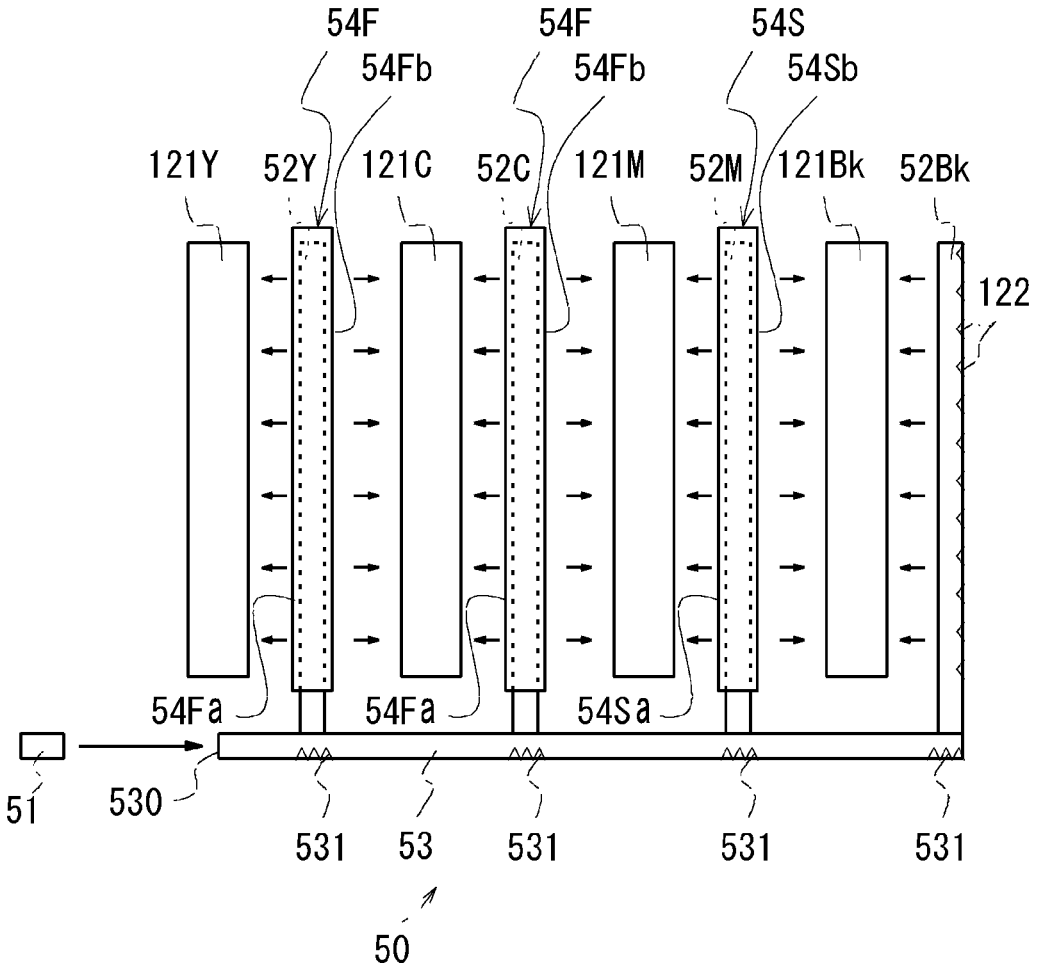
FIG. 7 is a schematic plan view showing a static elimination unit and peripheral components according to a second embodiment of the disclosure.

FIG. 7 is a schematic plan view showing a static elimination unit and peripheral components according to a second embodiment of the disclosure. In FIG. 2, the same constituents of the static elimination unit 50 as those of the first embodiment are given the same numeral, and detailed description thereof will not be repeated.

In the first embodiment, the illumination units 52Y, 52C, and 52M are each configured to emit the light only to one of the photosensitive bodies. In the second embodiment, in contrast, the illumination units 52Y, 52C, and 52M are each configured to emit the light to two photosensitive bodies. For example, the illumination unit 52Y located between the photosensitive body 121Y and the photosensitive body 121C emits the light not only to the photosensitive body 121Y, but also to the photosensitive body 121C. The same applies to the illumination units 52C and 52M.

For example, although the illumination unit 52Y is primarily configured to eliminate static electricity from the photosensitive body 121Y, the light that leaks from the illumination unit 52Y and proceeds toward the photosensitive body 121C is utilized as part of the static eliminating light for the photosensitive body 121C.

The static elimination unit 50 includes the light emitter 51 serving as light source of the static eliminating light, the illumination units 52Y, 52C, 52M, and 52Bk that respectively emit the light to the drum-shaped photosensitive bodies 121Y, 121C, 121M, and 121Bk, the light guide unit 53 that connects the illumination units 52Y, 52C, 52M, and 52Bk and guides the light from the light emitter 51 toward the illumination units 52Y, 52C, 52M, and 52Bk, shielding members 54F respectively covering the illumination units 52Y, 52C, and a shielding member 54S covering the illumination unit 52M.

The shielding members 54F respectively covering the illumination units 52Y, 52C are configured to rotate about the illumination units 52Y, 52C. The shielding members 54F each include elongate transmission paths 54Fa, 54Fb formed on the outer circumferential surface so as to extend in the longitudinal direction, through which the light can be transmitted. When the shielding member 54F rotates, the transmission paths 54Fa, 54Fb are displaced so as to transmit or block the light emitted from the illumination units 52Y, 52C.

The transmission paths 54Fa, 54Fb of the shielding member 54F covering the illumination unit 52Y are configured so as to allow, at a certain position, the light emitted from the illumination unit 52Y to reach the photosensitive bodies 121Y, 121C, and to disable the light emitted from the illumination unit 52Y from reaching the photosensitive bodies 121Y, 121C when the shielding member 54F rotates about the illumination unit 52Y to a different position. The same applies to the transmission path 54Fa, 54Fb of the shielding member 54F covering the illumination unit 52C.

The shielding member 54S covering the illumination unit 52M is configured to rotate about the illumination unit 52M, and includes elongate transmission paths 54Sa, 54Sb formed on the outer circumferential surface so as to extend in the longitudinal direction. When the shielding member 54S rotates, the transmission paths 54Sa, 54Sb are displaced so as to transmit or block the light emitted from the illumination unit 52M.

The transmission paths 54Sa, 54Sb of the shielding member 54S covering the illumination unit 52M are configured so as to allow the light emitted from the illumination unit 52M to reach the photosensitive bodies 121M, 121Bk, or to reach only the photosensitive body 121Bk, depending on the rotational position of the shielding member 54S.

Figure 8A:
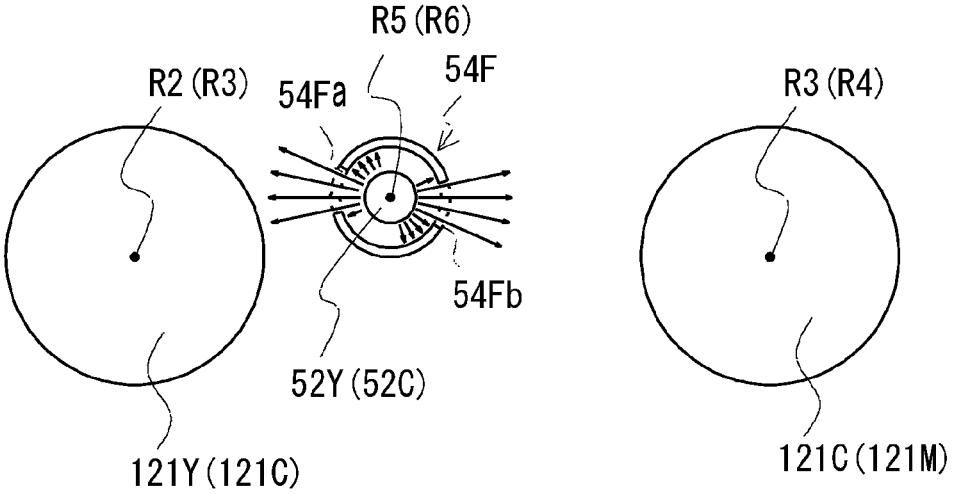
FIG. 8A and FIG. 8B are schematic drawings for explaining a positional relationship between a transmission path of the shielding member and a photosensitive body according to the second embodiment of the disclosure.
Figure 8B:
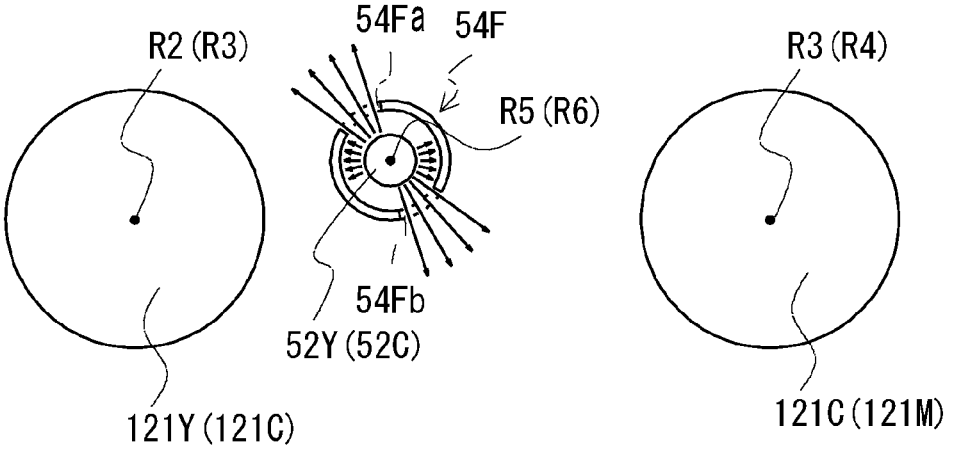

FIG. 8A and FIG. 8B are schematic drawings for explaining a positional relationship between the transmission paths 54Fa, 54Fb of the shielding member 54F and the photosensitive bodies 121Y, 121C, and 121M according to the second embodiment of the disclosure. As shown in FIG. 8A and FIG. 8B, the transmission path 54Fb of the shielding member 54F covering the illumination unit 52Y is formed so as to be positioned between the photosensitive body 121C and the illumination unit 52Y when the transmission path 54Fa is positioned between the photosensitive body 121Y and the illumination unit 52Y, and also to be displaced from the position between the photosensitive body 121C and the illumination unit 52Y when the transmission path 54Fa is displaced from the position between the photosensitive body 121Y and the illumination unit 52Y. Though not illustrated, the shielding member 54F also includes a pinion gear formed on a part of the outer circumferential surface like the shielding member 54 shown in FIG. 3 and FIG. 4, so as to rotate in linkage with the stroke of the retainer 127 supporting the primary transfer roller 126.

When the transmission path 54Fa of the shielding member 54F covering the illumination unit 52Y is positioned between the photosensitive body 121Y and the illumination unit 52Y and the transmission path 54Fb is positioned between the photosensitive body 121C and the illumination unit 52Y as shown in FIG. 8A, the light emitted from the illumination unit 52Y and serving as static eliminating light can reach the photosensitive bodies 121Y, 121C.

In contrast, when the transmission path 54Fa is displaced from the position between the photosensitive body 121Y and the illumination unit 52Y and the transmission path 54Fb is displaced from the position between the photosensitive body 121C and the illumination unit 52Y as shown in FIG. 8B, the light emitted from the illumination unit 52Y and serving as static eliminating light is unable to reach the photosensitive bodies 121Y, 121C.

The same also applies to the transmission paths 54Fa, 54Fb of the shielding member 54F covering the illumination unit 52C. Accordingly, when the transmission path 54Fa is positioned between the photosensitive body 121C and the illumination unit 52C and the transmission path 54Fb is positioned between the photosensitive body 121M and the illumination unit 52C, the light emitted from the illumination unit 52C and serving as static eliminating light can reach the photosensitive bodies 121C, 121M. In contrast, when the transmission path 54Fa is displaced from the position between the photosensitive body 121C and the illumination unit 52C and the transmission path 54Fb is displaced from the position between the photosensitive body 121M and the illumination unit 52C, the light emitted from the illumination unit 52C and serving as static eliminating light is unable to reach the photosensitive bodies 121C, 121M.

Figure 9A:
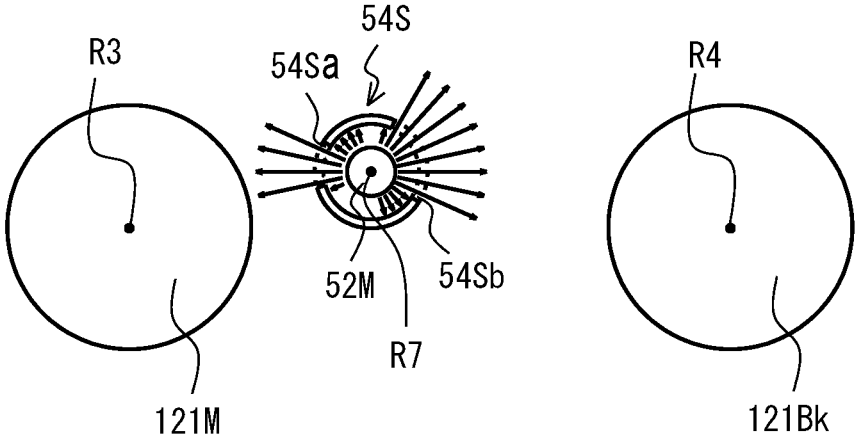
FIG. 9A and FIG. 9B are schematic drawings for explaining a positional relationship between a transmission path of a shielding member and a photosensitive body according to the third embodiment of the disclosure.
Figure 9B:
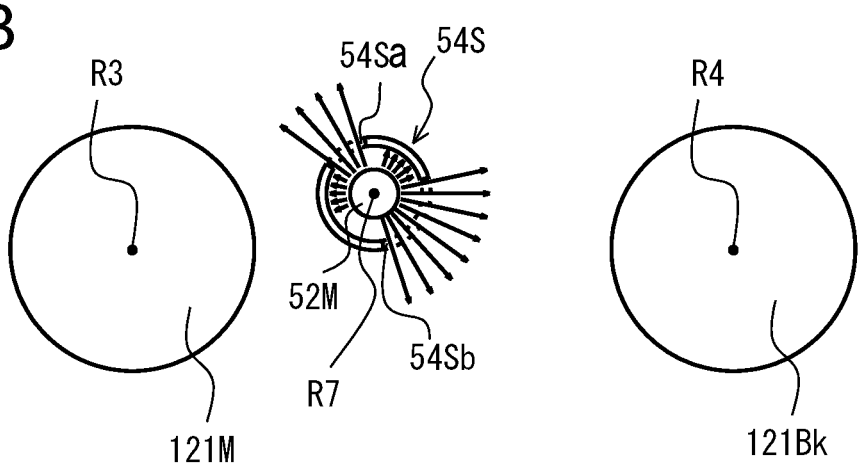

FIG. 9A and FIG. 9B are schematic drawings for explaining a positional relationship between the transmission paths 54Sa, 54Sb of the shielding member 54S and the photosensitive bodies 121M, 121Bk according to the third embodiment of the disclosure. As shown in FIG. 9A and FIG. 9B, the transmission path 54Sb of the shielding member 54S covering the illumination unit 52M is wider than the transmission path 54Sa in the circumferential direction, so that the transmission path 54Sb is positioned between the photosensitive body 121Bk and the illumination unit 52M, not only when the transmission path 54Sa is positioned between the photosensitive body 121M and the illumination unit 52M, but also when the transmission path 54Sa is deviated from the position between the photosensitive body 121M and the illumination unit 52M. Though not illustrated, the shielding member 54S also includes a pinion gear formed on a part of the outer circumferential surface like the shielding member 54 shown in FIG. 3 and FIG. 4, so as to rotate in linkage with the stroke of the retainer 127 supporting the primary transfer roller 126.

When the transmission path 54Sa of the shielding member 54S covering the illumination unit 52M is positioned between the photosensitive body 121M and the illumination unit 52M and the transmission path 54Sb is positioned between the photosensitive body 121Bk and the illumination unit 52M as shown in FIG. 9A, the light emitted from the illumination unit 52M and serving as static eliminating light reaches the photosensitive bodies 121M, 121Bk.

In contrast, when the transmission path 54Sb is positioned between the photosensitive body 121Bk and the illumination unit 52M although the transmission path 54Sa is deviated from the position between the photosensitive body 121M and the illumination unit 52M as shown in FIG. 9B, the light emitted from the illumination unit 52M and serving as static eliminating light can reach the photosensitive body 121Bk, but not the photosensitive body 121M.

Thus, in the second and third embodiment also, the single light emitter 51 serves as light source for the four illumination units 52Bk, 52Y, 52C, and 52M, and therefore the number of light sources can be reduced. In addition, each of the illumination units 52Y, 52C, and 52M is configured to emit the static eliminating light to two photosensitive bodies, which improves the static elimination efficiency. Further, in the monochrome printing operation, the photosensitive bodies 121Y, 121C, and 121M for yellow, cyan, and magenta, which are not used, are not irradiated with the static eliminating light, regardless that the illumination units emits the static eliminating light to two photosensitive bodies. Therefore, the photosensitive bodies 121Y, 121C, and 121M for yellow, cyan, and magenta are exempted from suffering optical fatigue. Consequently, the configuration according to these embodiments enable reduction in number of light sources of the static eliminating light, and restricts the static eliminating light from reaching the photosensitive bodies that are not used in the image forming operation, thereby preventing optical fatigue of those unused photosensitive bodies.

When the monochrome printing is performed by a conventional image forming apparatus, in other words when the photosensitive bodies for yellow, cyan, and magenta are not involved in the printing operation, the photosensitive bodies for yellow, cyan, and magenta are also irradiated with the static eliminating light, as is the photosensitive body for black. Accordingly, those unused photosensitive bodies may suffer optical fatigue, despite not being employed in the image forming operation for monochrome printing.

To prevent such optical fatigue, the photosensitive bodies that are not used for the monochrome image forming also have to be driven and charged. However, driving and charging the photosensitive bodies, despite being actually unnecessary, leads to shortened service life of the photosensitive bodies.

The configuration according to the foregoing embodiments, unlike the above, restricts the static eliminating light from reaching the photosensitive bodies that are not used in the image forming operation, thereby preventing optical fatigue of those unused photosensitive bodies, and also enables reduction in number of light sources of the static eliminating light.

Although the first to the third embodiments represent the case where the static eliminating light from the light emitter 51 is distributed by the light guide unit 53 thus to be emitted onto the surface of the photosensitive bodies 121Bk, 121Y, 121C, and 121M, in other words the illumination units 52Bk, 52Y, 52C, and 52M are connected in parallel to the light guide unit 53 as shown in FIG. 2, the disclosure is not limited to such a configuration. For example, the illumination units 52Bk, 52Y, 52C, and 52M may be connected in series along the direction in which the light travels, via a light guide unit 53A, as in a fourth embodiment shown in FIG. 10. In this case also, the shielding member 54, as well as the electric motor 128 and the retainer 127 necessary for driving the shielding member 54 may be configured in the same as the foregoing embodiments.

Figure 10:
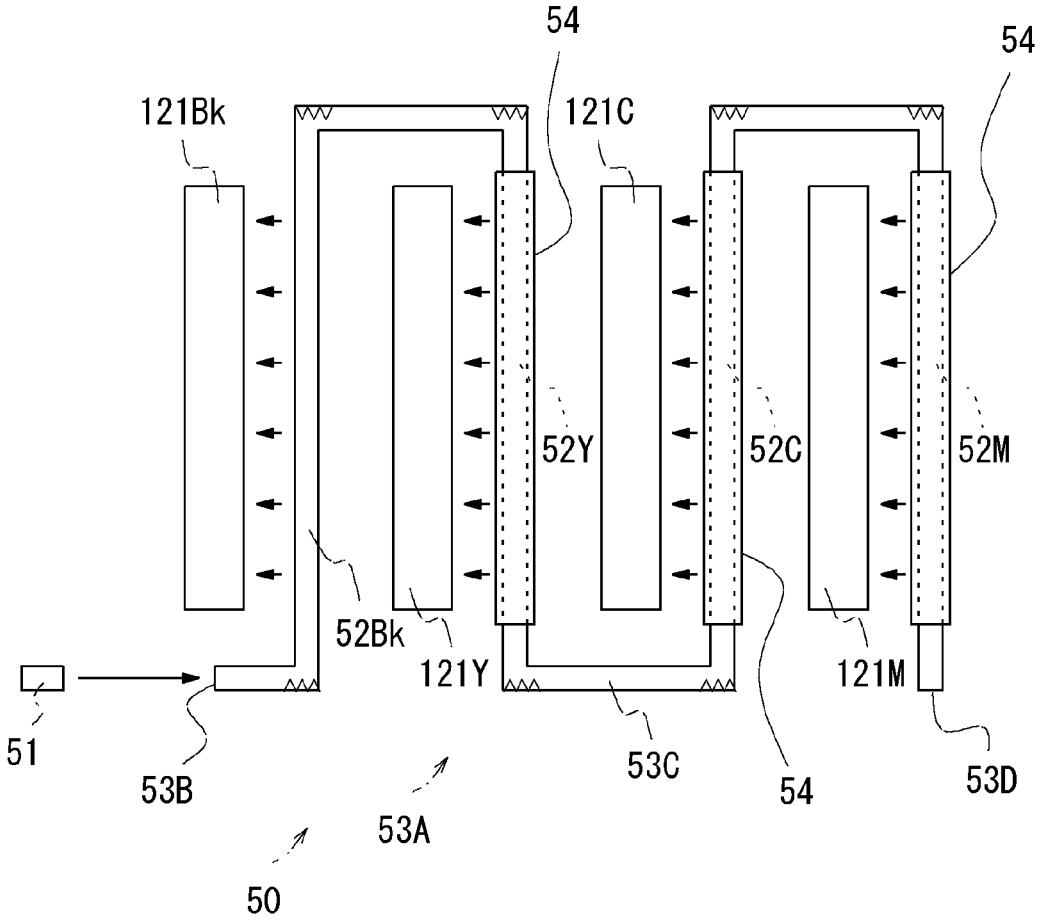
FIG. 10 is a schematic plan view showing a static elimination unit and peripheral components according to a fourth embodiment of the disclosure.

The light guide unit 53A shown in FIG. 10 includes a passage formed between a light entrance 53B opposed to the light emitter 51 and a distal end 53D of a light guide member 53C that guides the light from the light emitter 51. The passage includes emitting surfaces respectively provided at positions opposed to the photosensitive bodies 121Bk, 121Y, 121C, and 121M, so as to extend along the rotation axis of the photosensitive bodies 121Bk, 121Y, 121C, and 121M and to oppose the surfaces thereof.

The illumination units 52Bk, 52Y, 52C, and 52M each include such an emitting surface, and are each configured to reflect the static eliminating light toward the surface of the corresponding one of the photosensitive bodies 121Bk, 121Y, 121C, and 121M. In this case also, the image forming operation according to the flowchart of FIG. 6 may equally be performed.

Further, although the foregoing embodiments represent the case of rotating the shielding member 54, 54F, 54S in linkage with the stroke of the retainer 127 for excluding the three colors, the control method of the rotation of the shielding member 54, 54F, 54S is not limited to the foregoing embodiments. For example, an independent moving mechanism may be provided, and the controller 100 may recognize the operation mode of the image forming, to thereby control the moving mechanism.

Further, although the foregoing embodiments represent the case where the shielding member 54, 54F, 54S includes one or more openings that serve as transmission path 54*a*, 54Fa, 54Fb, 54Sa, 54Sb, the configuration of the transmission path is not limited to the above. For example, a light-transmissive resin material such as acrylic may be employed to form the transmission path.

Figure 11:
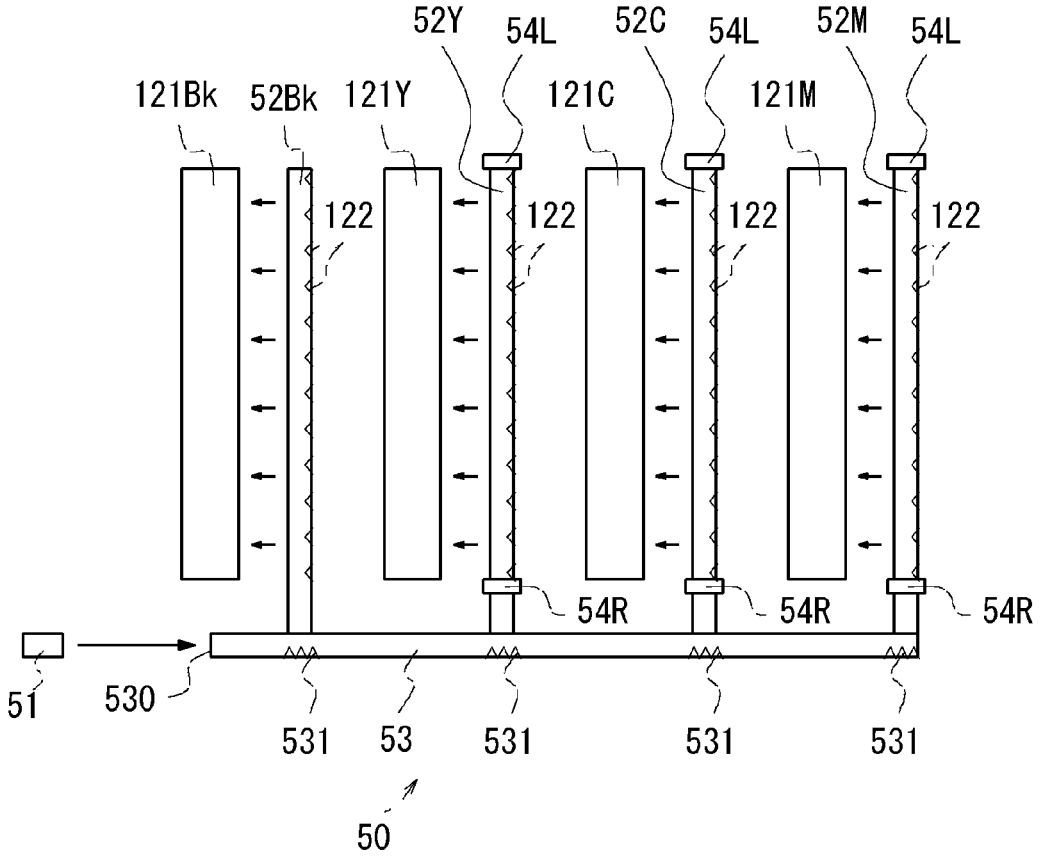
FIG. 11 is a schematic plan view showing a static elimination unit and peripheral components according to a fifth embodiment of the disclosure.

Hereunder, a fifth embodiment of the disclosure will be described. FIG. 11 is a schematic plan view showing a static elimination unit and peripheral components according to the fifth embodiment of the disclosure. The configuration of the components not specifically referred to hereunder is the same as that of the first embodiment. The static elimination unit 50 includes the light emitter 51 serving as light source of the static eliminating light, the illumination units 52Y, 52C, 52M, and 52Bk that respectively emit the light to the drum-shaped photosensitive bodies 121Y, 121C, 121M, and 121Bk, and the light guide unit 53 that connects the illumination units 52Y, 52C, 52M, and 52Bk and guides the light from the light emitter 51 toward the illumination units 52Y, 52C, 52M, and 52Bk.

The illumination units 52Bk, 52Y, 52C, and 52M are formed of a light-transmissive resin material such as acrylic, like the light guide unit 53, and each include a plurality of reflection patterns 122 including reverse V-shaped prisms and formed on the side opposite to the corresponding one of the photosensitive bodies 121Bk, 121Y, 121C, and 121M.

The illumination units 52Y, 52C, and 52M respectively opposed to the photosensitive bodies 121Y, 121C, and 121M for yellow, cyan, and magenta are each supported by support members 54R, 54L at the respective end portions in the longitudinal direction or in the vicinity thereof, and configured so as to rotate about a rotation axis coinciding with the center in the radial direction.

Figure 12:
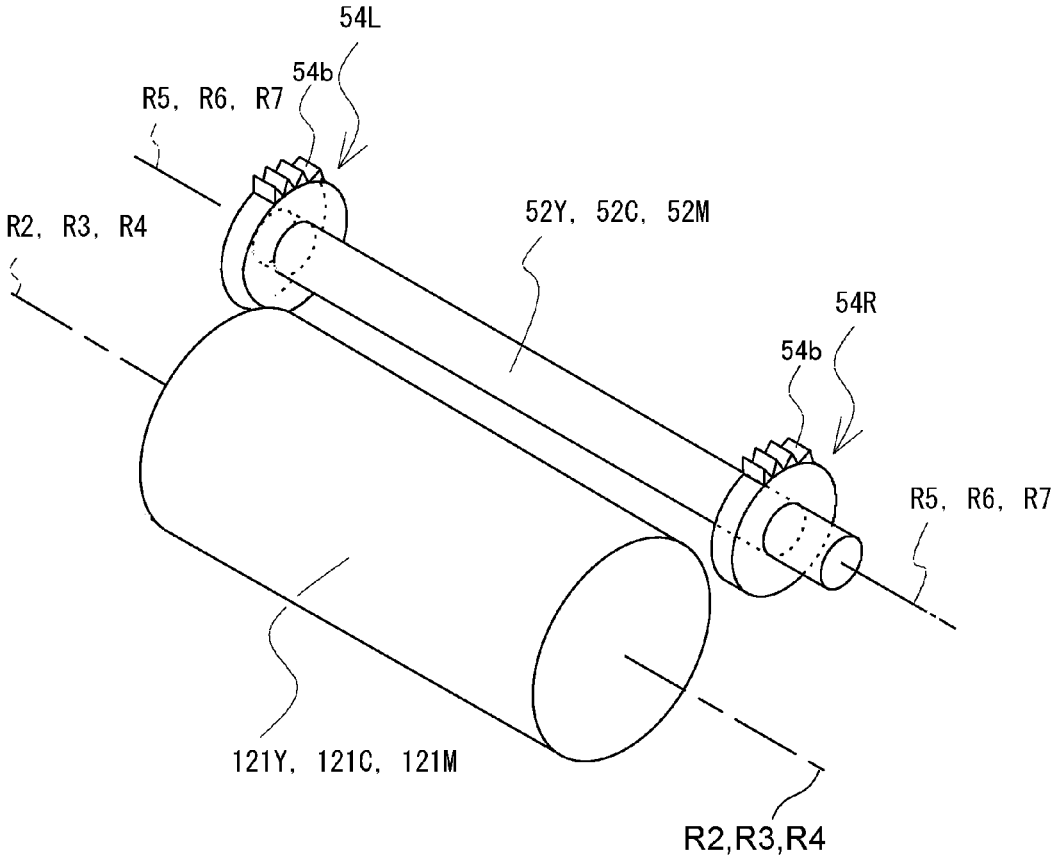
FIG. 12 is a schematic perspective view showing an illumination unit and peripheral components according to the fifth embodiment of the disclosure.

FIG. 12 is a schematic perspective view showing an illumination unit and peripheral components according to the fifth embodiment of the disclosure. The illumination units 52Y, 52C, and 52M are each supported by support members 54R, 54L at the respective end portions or in the vicinity thereof. The support members 54R, 54L each include a pinion gear 54*b* formed on a part of the outer circumferential surface to be meshed with the rack formed on the retainer, so that the support members 54R, 54L and the illumination units 52Y, 52C, and 52M each supported by the support members 54R, 54L can rotate about the rotation axes R5, R6, R7, respectively.

Figure 13A:
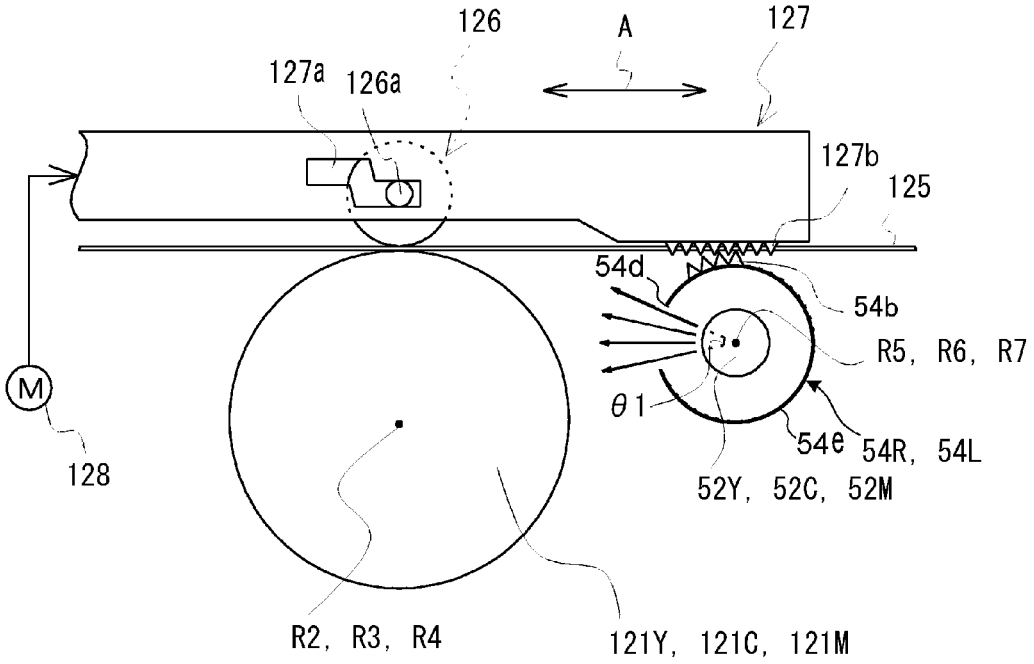
FIG. 13A and FIG. 13B are partially cut away front views showing the illumination unit and the peripheral components according to the fifth embodiment of the disclosure.
Figure 13B:
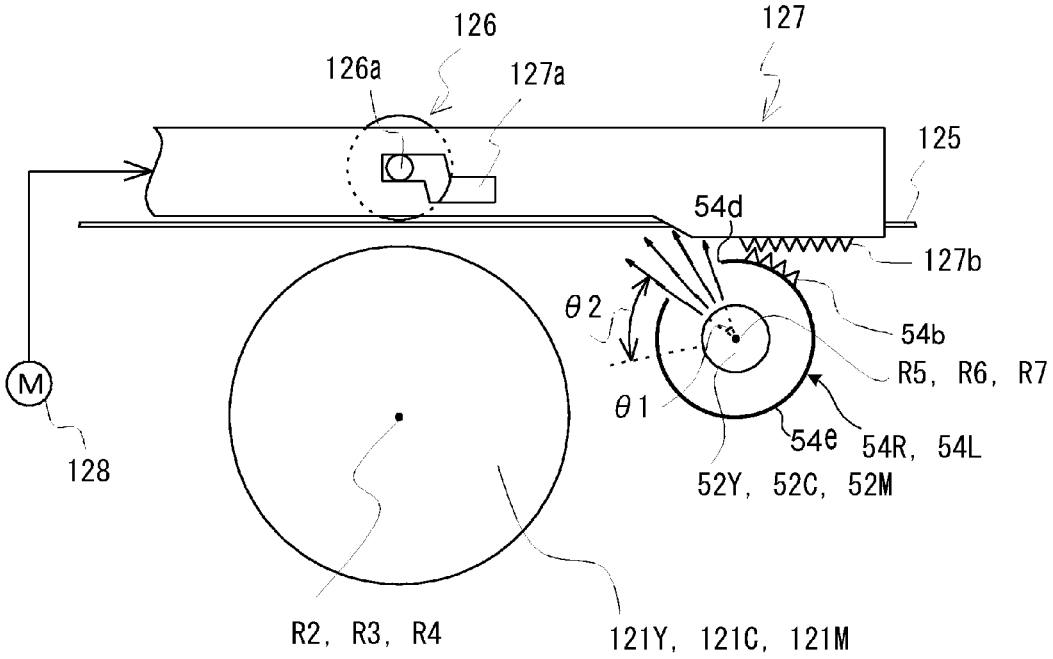

FIG. 13A and FIG. 13B are partially cut away front views showing the illumination unit and the peripheral components according to the fifth embodiment of the disclosure. As shown in FIG. 13A and FIG. 13B, the illumination range (illumination angle θ1) of the illumination units 52Y, 52C, and 52M in the rotating direction thereof is not 360 degrees, but limited to a narrow angle. To limit the illumination angle to a narrow angle (concentration form), for example a reflection pattern, or a cross-sectional shape of the illumination units 52Y, 52C, and 52M in the circumferential direction may be employed.

Referring to FIG. 13A, a shielding film 54*e* is attached to the circumferential surface of each of the illumination units 52Y, 52C, and 52M, except for a partial region 54*d* of the circumferential surface in the rotating direction, so that the static eliminating light is emitted onto the surface of the photosensitive bodies 121Y, 121C, and 121M only through the partial region 54*d* of the circumferential surface in the rotating direction. FIG. 13A illustrates a situation where the circumferential partial region 54*d* is opposed to the surface of the photosensitive bodies 121Y, 121C, and 121M, in other words the illumination units 52Y, 52C, and 52M are each rotated to an angular position where the light emitted therefrom and serving as static eliminating light can reach the corresponding one of the photosensitive bodies 121Y, 121C, and 121M.

The primary transfer roller 126 serves to transfer the toner image onto the intermediate transfer belt 125. The primary transfer roller 126 is supported by the retainer 127, and the rod 126*a* included in the primary transfer roller 126 is slidably engaged with the control slot 127*a* of a Z-shape in a front view formed in the retainer 127.

The retainer 127 is driven by the electric motor 128 so as to move along the non-illustrated rail in the direction indicated by an arrow A. When the retainer 127 moves to the right in FIG. 13A, the rod 126*a* of the primary transfer roller 126 moves to the left inside the control slot 127*a* as shown in FIG. 13B, and therefore the primary transfer roller 126 moves away from the photosensitive bodies 121Y, 121C, and 121M. The action of the electric motor 128 is controlled by the controller 100 (see FIG. 5) described above in details. The retainer 127 and the electric motor 128 exemplify the driving mechanism in the disclosure.

When the primary transfer roller 126 moves away from the photosensitive bodies 121Y, 121C, and 121M, the tension applied to the intermediate transfer belt 125 changes, so that the intermediate transfer belt 125 is lifted up and moves away from the photosensitive bodies 121Y, 121C, and 121M. Conversely, when the retainer 127 moves to the left, the rod 126*a* of the primary transfer roller 126 slides to the right inside the control slot 127*a* as shown in FIG. 13A, and therefore the primary transfer roller 126 moves toward the photosensitive bodies 121Y, 121C, and 121M, to thereby bring the intermediate transfer belt 125 into contact with the photosensitive bodies 121Y, 121C, and 121M. Here, the rod 126*a* of the primary transfer roller 126, the retainer 127, the control slot 127*a*, and the electric motor 128 exemplify the constituents of the contact control mechanism in the disclosure.

The retainer 127 includes the rack 127*b* formed on the lower face so as to mesh with the pinion gear 54*b* formed on a part of the outer circumferential surface of the support members 54R, 54L, so that when the retainer 127 moves to the right in FIG. 13A the support members 54R, 54L and the illumination units 52Y, 52C, and 52M supported by the support members 54R, 54L are made to rotate clockwise as shown in FIG. 13B. Accordingly, the circumferential partial region 54*d* is displaced to a position not opposed to the surface of the photosensitive bodies 121Y, 121C, and 121M, so that the photosensitive bodies 121Y, 121C, and 121M are deviated from the respective illumination ranges of the illumination units 52Y, 52C, and 52M. Consequently, the light emitted from the illumination units 52Y, 52C, and 52M is unable to reach the photosensitive bodies 121Y, 121C, and 121M.

Here, an equation of $2r\pi\ \theta 2/360=L$ can be established, where r denotes the radius of the support members 54R, 54L, θ2 denotes the rotation angle of the support members 54R, 54L, and L denotes the distance traveled by the retainer 127. Therefore, when the magnitude of the required rotation angle θ2 is determined, an appropriate radius r of the support members 54R, 54L can be obtained.

Referring now to the flowchart shown in FIG. 6, an example of the image forming operation performed by the controller 100 of the image forming apparatus 1 according to the fifth embodiment of the disclosure will be described hereunder. Unless otherwise specifically noted, the operation according to the fifth embodiment is the same as that of the first embodiment.

Upon deciding that the monochrome printing job has been instructed ("monochrome" at step S1), the controller 100 controls the electric motor 128 so as to move the retainer 127 in the direction to cause the intermediate transfer belt 125 to move away from the photosensitive bodies 121Y, 121C, and 121M for yellow, cyan, and magenta (step S2). Accordingly, the illumination units 52Y, 52C, and 52M supported by the support members 54R, 54L are caused to rotate clockwise to such a position where the circumferential partial region 54*d* is not opposed to the surface of the photosensitive bodies 121Y, 121C, and 121M as shown in FIG. 13B, so that the photosensitive bodies 121Y, 121C, and 121M are deviated from the respective illumination ranges of the illumination units 52Y, 52C, and 52M.

After the image forming operation is finished, the controller 100 turns on the light emitter 51 (step S5). The light from the light emitter 51 reaches the photosensitive body 121Bk through the light guide unit 53 and the illumination unit 52Bk. However, the illumination units 52Y, 52C, and 52M are disposed in the position shown in FIG. 13B, where the photosensitive bodies 121Y, 121C, and 121M are deviated from the respective illumination ranges of the illumination units 52Y, 52C, and 52M, and therefore the light from the light emitter 51 is unable to reach the photosensitive bodies 121Y, 121C, and 121M. Accordingly, although the surface of the photosensitive body 121Bk is irradiated with the static eliminating light, the respective surfaces of the photosensitive bodies 121Y, 121C, and 121M are not irradiated with the static eliminating light.

In contrast, in the case where the controller 100 decides at step S1 that the instruction from the operation unit 47 is for color printing ("color" at step S1), the controller 100 controls the electric motor 128 to drive the retainer 127 so as to bring the intermediate transfer belt 125 into contact with the photosensitive bodies 121Y, 121C, and 121M for yellow, cyan, and magenta (step S6). As result, the circumferential partial region 54*d* is positioned so as to oppose the surface of the photosensitive bodies 121Y, 121C, and 121M as shown in FIG. 13A, so that the photosensitive bodies 121Y, 121C, and 121M enters the respective illumination ranges of the illumination units 52Y, 52C, and 52M. Thereafter, the color image forming operation is performed according to steps S7, S8, in the same way as the first embodiment.

After the image forming operation is finished, the controller 100 turns on the light emitter 51 (step S5). Since the circumferential partial region 54*d* is positioned so as to oppose the surface of the photosensitive bodies 121Y, 121C, and 121M as shown in FIG. 13A, so that the photosensitive bodies 121Y, 121C, and 121M remain in the respective illumination ranges of the illumination units 52Y, 52C, and 52M, the light from the light emitter 51 reaches not only the photosensitive body 121Bk, but also the photosensitive bodies 121Y, 121C, and 121M.

As described above, the light emitter 51, which is a single independent component, can serve as light source for the illumination units 52Bk, 52Y, 52C, and 52M. In addition, when the monochrome printing is performed, the static eliminating light from the illumination units 52Y, 52C, and 52M is unable to reach the photosensitive bodies 121Y, 121C, and 121M for yellow, cyan, and magenta, which are not used for image forming.

Thus, in the fifth embodiment also, the single light emitter 51 serves as light source for the four illumination units 52Bk, 52Y, 52C, and 52M, and therefore the number of light sources can be reduced. In addition, when the monochrome printing is performed the photosensitive bodies 121Y, 121C, and 121M for yellow, cyan, and magenta, which are not used, are not irradiated with the static eliminating light. Therefore, the photosensitive bodies 121Y, 121C, and 121M for yellow, cyan, and magenta are exempted from suffering optical fatigue, despite not being subjected to the driving and charging process like the photosensitive body 121Bk for black. Consequently, the configuration according to this embodiment enables reduction in number of light sources of the static eliminating light, and restricts the static eliminating light from reaching the photosensitive bodies that are not used in the image forming operation, thereby preventing optical fatigue of those unused photosensitive bodies.

Here, although the fifth embodiment also represents the case where the light emitter 51 is turned on to perform the static elimination after the image forming operation is finished, the static elimination may be performed at a different timing.

Figure 14:
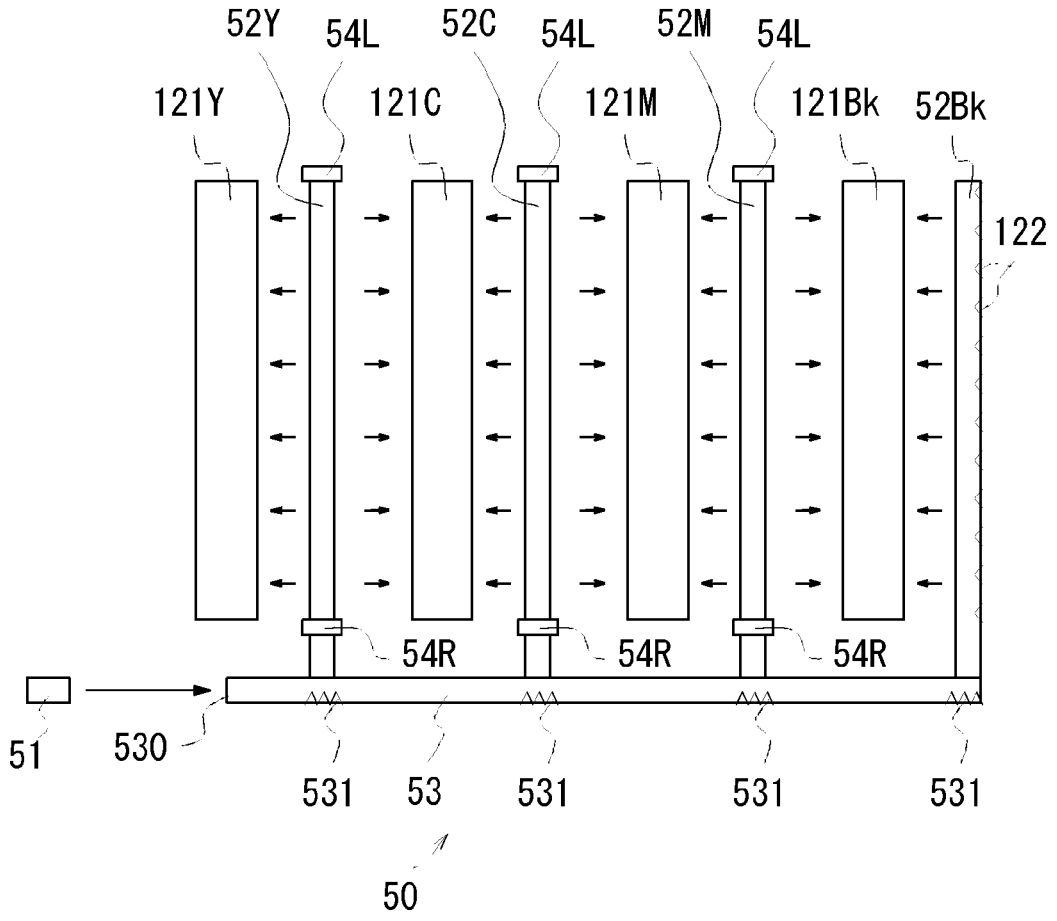
FIG. 14 is a schematic plan view showing a static elimination unit and peripheral components according to a sixth embodiment of the disclosure.

FIG. 14 is a schematic plan view showing a static elimination unit and peripheral components according to a sixth embodiment of the disclosure. In FIG. 11, the same constituents of the static elimination unit 50 as those of the fifth embodiment are given the same numeral, and detailed description thereof will not be repeated.

In the fifth embodiment, the illumination units 52Y, 52C, and 52M are each configured to emit the light only to one of the photosensitive bodies. In the sixth embodiment, in contrast, the illumination units 52Y, 52C, and 52M are each configured to emit the light to two photosensitive bodies. For example, the illumination unit 52Y located between the photosensitive body 121Y and the photosensitive body 121C emits the light not only to the photosensitive body 121Y, but also to the photosensitive body 121C. The same applies to the illumination units 52C and 52M.

For example, although the illumination unit 52Y is primarily configured to eliminate static electricity from the photosensitive body 121Y, the light that leaks from the illumination unit 52Y and proceeds toward the photosensitive body 121C is utilized as part of the static eliminating light for the photosensitive body 121C.

The static elimination unit 50 includes the light emitter 51 serving as light source of the static eliminating light, the illumination units 52Y, 52C, 52M, and 52Bk that respectively emit the light to the drum-shaped photosensitive bodies 121Y, 121C, 121M, and 121Bk, and the light guide unit 53 that connects the illumination units 52Y, 52C, 52M, and 52Bk and guides the light from the light emitter 51 toward the illumination units 52Y, 52C, 52M, and 52Bk.

The illumination units 52Y, 52C are configured so as to rotate about the rotation axis coinciding with the center in the radial direction. The illumination range of the illumination unit 52Y is set so as to allow the light emitted from the illumination unit 52Y to reach the photosensitive bodies 121Y, 121C, or to disable the light emitted from the illumination unit 52Y from reaching the photosensitive bodies 121Y, 121C, depending on the angular position of the illumination unit 52Y In other words, the illumination unit 52Y includes two of the circumferential partial regions 54*d* that allow the light emitted from the illumination unit 52Y to reach the photosensitive bodies 121Y, 121C, provided in a part of the illumination unit 52Y in the rotating direction. The same also applies to the illumination unit 52C, with respect to the illumination range and the configuration of the circumferential partial regions 54*d*.

The illumination unit 52M is configured so as to rotate about the rotation axis extending in the longitudinal direction and coinciding with the center in the radial direction. The illumination unit 52M includes two of the circumferential partial regions 54*d* that allow the light emitted from the illumination unit 52M to reach the photosensitive bodies 121M, 121Bk, provided in a part of the illumination unit 52M in the rotating direction. The illumination unit 52M is configured so as to allow the light emitted from the illumination unit 52M to reach both of the photosensitive bodies 121M, 121Bk or to reach only the photosensitive body 121Bk, depending on the rotational position of the illumination unit 52M, in other words the angular position of two of the circumferential partial regions 54*d* in the rotating direction.

Figure 15A:
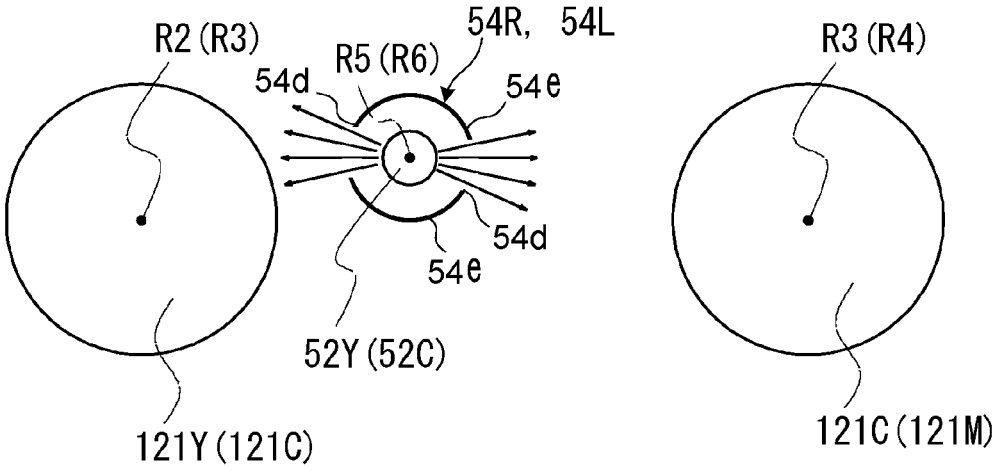
FIG. 15A and FIG. 15B are schematic drawings for explaining a relationship between a posture of an illumination unit and a photosensitive body according to the sixth embodiment of the disclosure.
Figure 15B:
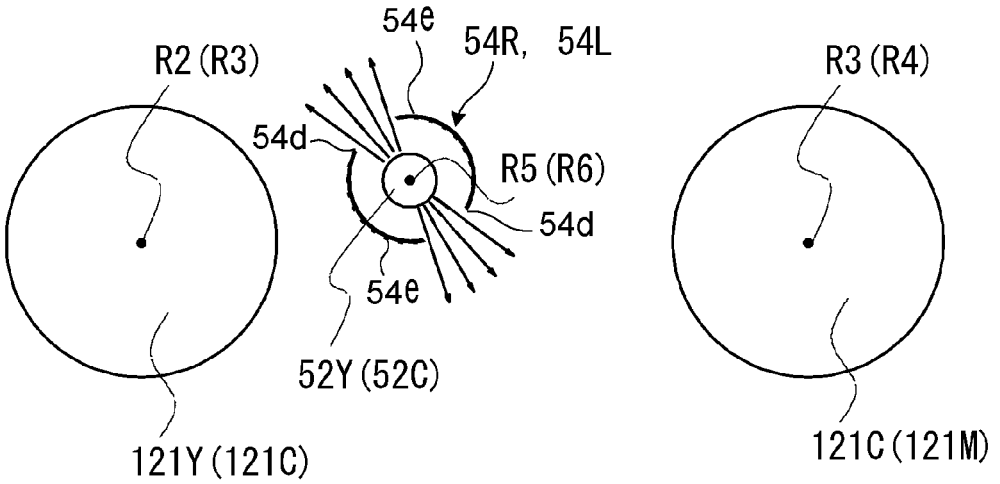

FIG. 15A and FIG. 15B are schematic drawings for explaining a relationship between the posture of the illumination units 52Y, 52C and the photosensitive bodies 121Y, 121C, and 121M according to the sixth embodiment of the disclosure. As shown in FIG. 15A and FIG. 15B, the illumination range of the illumination unit 52Y is set so as to allow the light emitted from the illumination unit 52Y to reach the photosensitive bodies 121Y, 121C, or to disable the light emitted from the illumination unit 52Y from reaching the photosensitive bodies 121Y, 121C, depending on the position of two of the circumferential partial regions 54*d* with respect to the photosensitive bodies 121Y, 121C. The same also applies to the illumination unit 52C. Though not illustrated, each of the illumination units 52Y, 52C shown in FIG. 15A and FIG. 15B also includes a pinion gear formed on a part of the outer circumferential surface, like the illumination units 52Y, 52C shown in FIG. 12, FIG. 13A, and FIG. 13B, so as to rotate in linkage with the stroke of the retainer 127 supporting the primary transfer roller 126.

When the illumination unit 52Y is positioned such that, as shown in FIG. 15A, one of the circumferential partial regions 54*d* is opposed to the photosensitive body 121Y and the other of the circumferential partial regions 54*d* is opposed to the photosensitive body 121C, so that the photosensitive bodies 121Y, 121C are included in the illumination range of the illumination unit 52Y, the light emitted from the illumination unit 52Y and serving as static eliminating light can reach the photosensitive bodies 121Y, 121C.

In contrast, when the illumination unit 52Y is positioned such that, as shown in FIG. 15B, neither of the circumferential partial regions 54*d* are opposed to the photosensitive body 121Y or 121C, so that the photosensitive bodies 121Y, 121C are deviated from the illumination range of the illumination unit 52Y, the light emitted from the illumination unit 52Y and serving as static eliminating light is unable to reach the photosensitive bodies 121Y, 121C.

The same also applies to the illumination unit 52C. When the photosensitive bodies 121C, 121M are included in the illumination range of the illumination unit 52C, the light emitted from the illumination unit 52C and serving as static eliminating light can reach the photosensitive bodies 121C, 121M, and when the photosensitive bodies 121C, 121M are deviated from the illumination range of the illumination unit 52C, the light emitted from the illumination unit 52C and serving as static eliminating light is unable to reach the photosensitive bodies 121C, 121M.

The position of two of the circumferential partial regions 54*d* of the illumination units 52Y, 52C is switched between the position opposed to the corresponding photosensitive bodies and the position deviated therefrom, by the stroke of the retainer 127 driven by the electric motor 128 under the control of the controller 100.

Figure 16A:
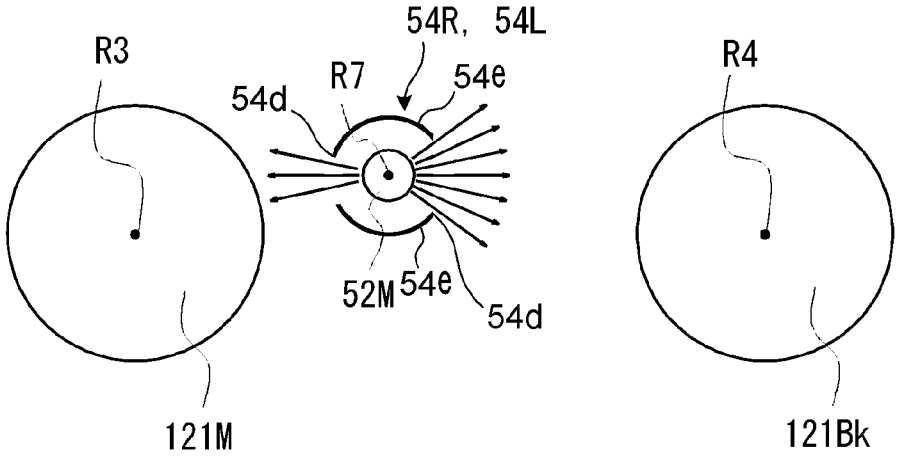
FIG. 16A and FIG. 16B are schematic drawings for explaining another relationship between a posture of the illumination unit and the photosensitive body according to the sixth embodiment of the disclosure.
Figure 16B:
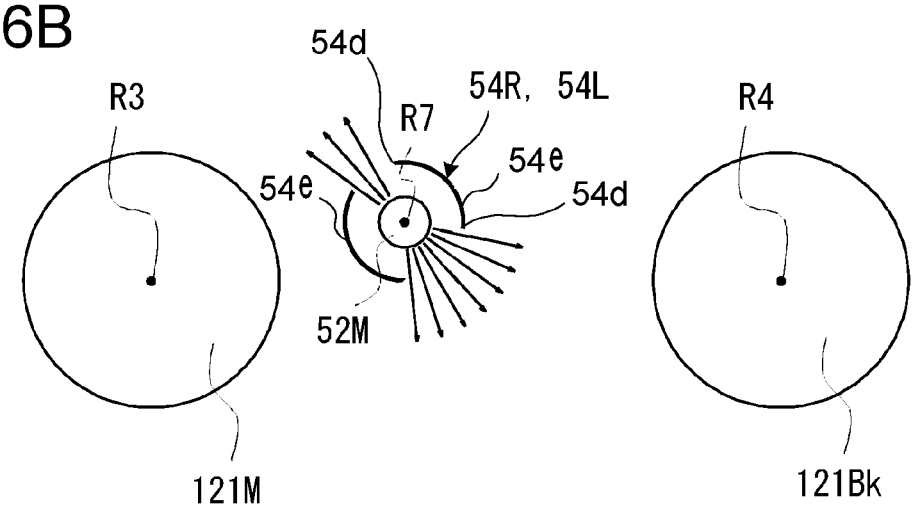

FIG. 16A and FIG. 16B are schematic drawings for explaining another relationship between a posture of the illumination unit 52M and the photosensitive bodies 121M, 121Bk according to the sixth embodiment of the disclosure. As shown in FIG. 16A and FIG. 16B, the illumination range of the illumination unit 52M is set so as to be switched between the state where the light from the illumination unit 52M reaches the photosensitive bodies 121M, 121Bk and the state where the light from the illumination unit 52M only reaches the photosensitive body 121Bk, depending on the position of the illumination unit 52M in the rotating direction. When the photosensitive bodies 121M, 121Bk are included in the illumination range of the illumination unit 52M as shown in FIG. 16A, the light emitted from the illumination unit 52M and serving as static eliminating light can reach the photosensitive bodies 121M, 121Bk.

For example, making the illumination angle with respect to the photosensitive body 121Bk wider than the illumination angle with respect to the photosensitive body 121M enables the light from the illumination unit 52M to reach only the photosensitive body 121Bk as shown in FIG. 16B, by switching two of the circumferential partial regions 54*d* between the position opposed to the corresponding photosensitive bodies and the position deviated therefrom. Increasing the width of one of two of the circumferential partial regions 54*d* in the circumferential direction of the illumination unit makes the illumination angle of the light emitted onto the photosensitive body through the wider one of the circumferential partial regions 54*d* a wide angle light (diffusion form). When the photosensitive body 121Bk is included in the illumination range of the illumination unit 52M although the photosensitive body 121M is deviated therefrom as shown in FIG. 16B, the light emitted from the illumination unit 52M and serving as static eliminating light reaches the photosensitive body 121Bk, but not the photosensitive body 121M.

The position of two of the circumferential partial regions 54*d* of the illumination unit 52M is switched between the position opposed to the corresponding photosensitive bodies and the position deviated therefrom, by the stroke of the retainer 127 driven by the electric motor 128 under the control of the controller 100.

Thus, in the sixth embodiment also, the single light emitter 51 serves as light source for the four illumination units 52Bk, 52Y, 52C, and 52M, and therefore the number of light sources can be reduced. In addition, each of the illumination units 52Y, 52C, and 52M is configured to emit the static eliminating light to two photosensitive bodies, which improves the static elimination efficiency. Further, in the monochrome printing operation, the photosensitive bodies 121Y, 121C, and 121M for yellow, cyan, and magenta, which are not used, are not irradiated with the static eliminating light, regardless that the illumination units emits the static eliminating light to two photosensitive bodies. Therefore, the photosensitive bodies 121Y, 121C, and 121M for yellow, cyan, and magenta are exempted from suffering optical fatigue. Consequently, the configuration according to this embodiment enables reduction in number of light sources of the static eliminating light, and restricts the static eliminating light from reaching the photosensitive bodies that are not used in the image forming operation, thereby preventing optical fatigue of those unused photosensitive bodies.

To realize the sixth embodiment, the illumination unit 52M having different illumination ranges from those of the illumination units 52Y, 52C has to be prepared, in order to allow the light from the illumination unit 52M to reach only the photosensitive body 121Bk and not the photosensitive body 121M. In other words, the illumination units of different configurations have to be separately designed and manufactured, which may lead to an increase in manufacturing cost. Therefore, the configuration of the illumination unit 52M may also be adopted for the illumination units 52Y, 52C.

In this case, however, the light from the illumination unit 52Y may reach the photosensitive body 121C, or the light from the illumination unit 52C may reach the photosensitive body 121M, when such illumination is not necessary.

Figure 17A:
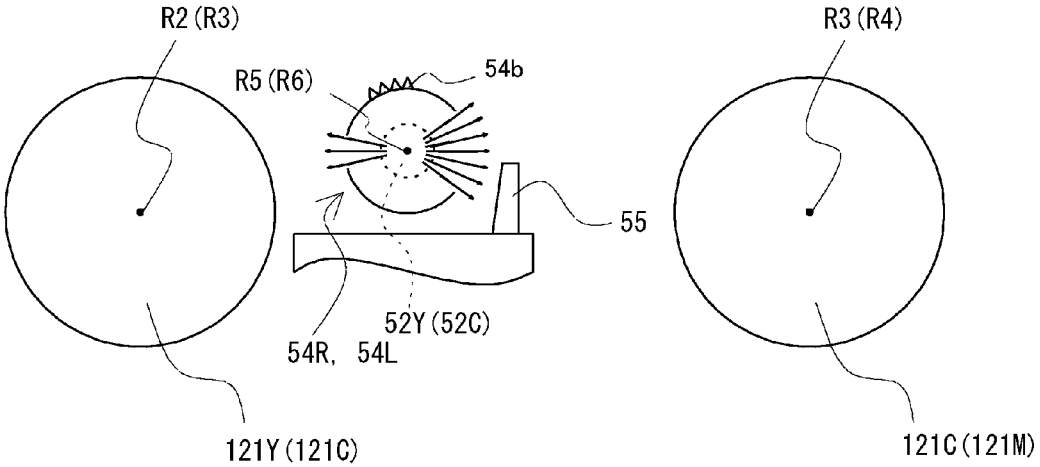
FIG. 17A and FIG. 17B are partially cut away front views showing an illumination unit and peripheral components according to a seventh embodiment of the disclosure.
Figure 17B:
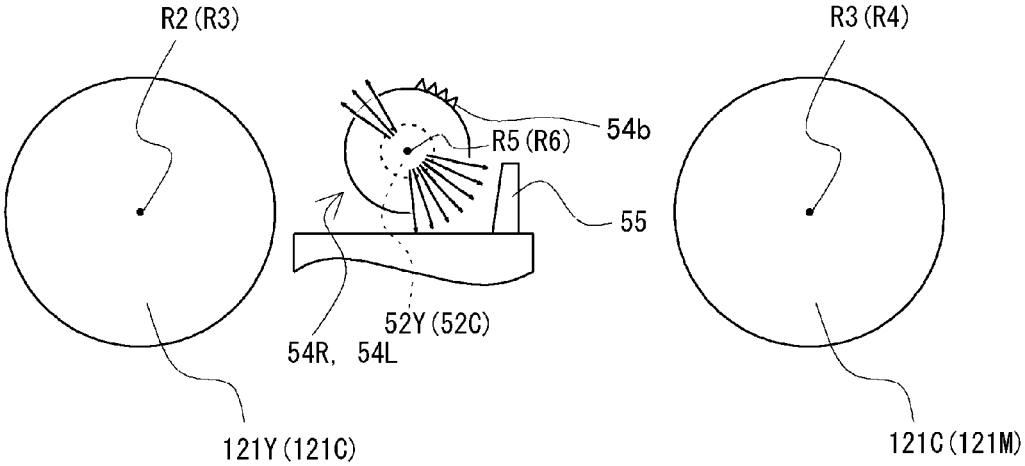

Accordingly, a shielding member 55 may be provided between the illumination unit 52Y and the photosensitive bodies 121Y, 121C as a seventh embodiment shown in FIG. 17A and FIG. 17B, so as to restrict the light from the illumination unit 52Y from reaching the photosensitive body 121C when the illumination is unnecessary as shown in FIG. 17B. The shielding member 55 may also be provided for the illumination unit 52C, as for the illumination unit 52Y The shielding member 55 may be located, for example, on a cleaning device that cleans the photosensitive bodies 121Y, 121C. In addition, the configuration of the illumination unit 52M may also be adopted for the illumination unit 52Bk. Here, the shielding member 55 exemplifies the shielding member in the disclosure.

Although the fifth to the seventh embodiments represent the case where the static eliminating light from the light emitter 51 is distributed by the light guide unit 53 thus to be emitted onto the surface of the photosensitive bodies 121Bk, 121Y, 121C, and 121M, in other words the illumination units 52Bk, 52Y, 52C, and 52M are connected in parallel to the light guide unit 53, for example as shown in FIG. 11, the disclosure is not limited to such a configuration. For example, the illumination units 52Bk, 52Y, 52C, and 52M may be connected in series along the direction in which the light travels, via the light guide unit 53A, as in an eighth embodiment shown in FIG. 18.

Figure 18:
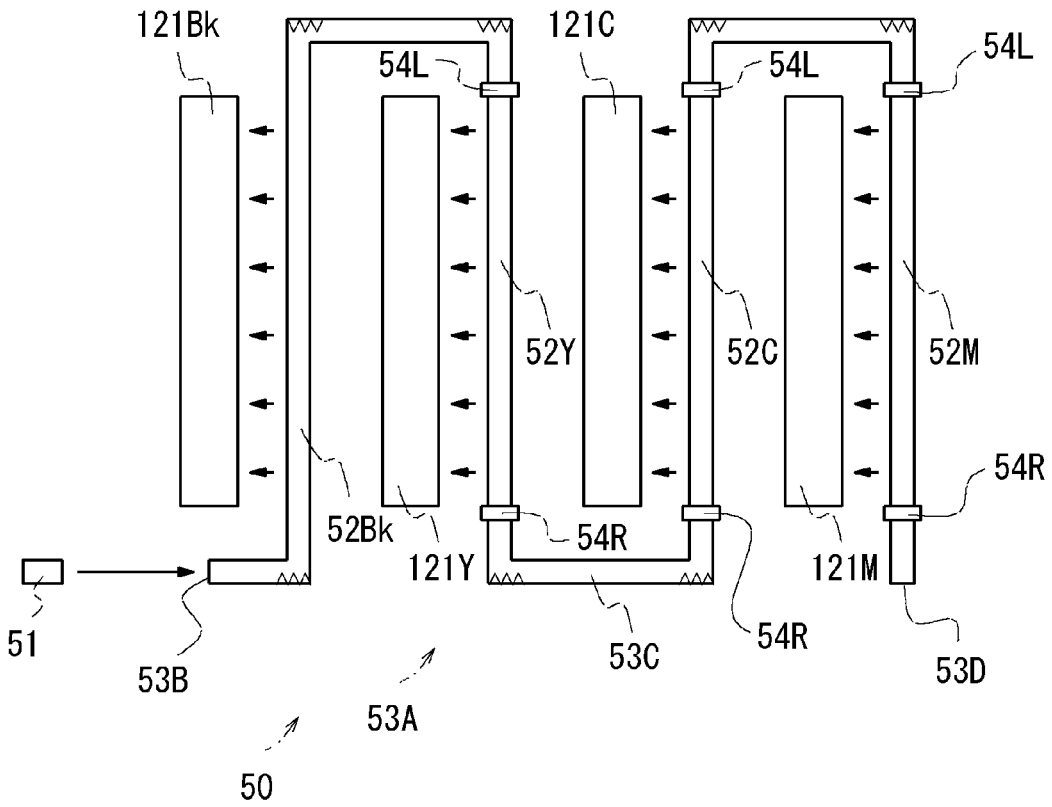
FIG. 18 is a schematic plan view showing a static elimination unit and peripheral components according to an eighth embodiment of the disclosure.

The light guide unit 53A shown in FIG. 18 includes a passage formed between the light entrance 53B opposed to the light emitter 51 and the distal end 53D of the light guide member 53C that guides the light from the light emitter 51. The passage includes emitting surfaces respectively provided at positions opposed to the photosensitive bodies 121Bk, 121Y, 121C, and 121M, so as to extend along the rotation axis of the photosensitive bodies 121Bk, 121Y, 121C, and 121M and to oppose the surfaces thereof.

The illumination units 52Bk, 52Y, 52C, and 52M each include such an emitting surface, and are each configured to reflect the static eliminating light toward the surface of the corresponding one of the photosensitive bodies 121Bk, 121Y, 121C, and 121M. In this case also, the image forming operation described with reference to the flowchart of FIG. 6 may equally be performed.

It is to be noted that the configurations and arrangements illustrated in FIG. 1 to FIG. 18 merely represent some exemplary embodiments of the disclosure, and are not intended to limit the configurations and arrangements of the disclosure.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a plurality of photosensitive bodies;

a plurality of illumination units respectively opposed to the plurality of photosensitive bodies, and each configured to emit static eliminating light onto a surface of the corresponding photosensitive body;

a light emitter that serves as light source;

a light guide unit configured to guide light from the light emitter toward the plurality of illumination units;

a driving mechanism configured to switch between allowing the illumination unit to emit light and restricting the illumination unit from emitting light, to the photosensitive body;

a control unit configured to cause the driving mechanism to perform a light emitting operation including allowing the illumination unit opposed to the photosensitive body being used for image forming to emit light to the photosensitive body, and restricting the illumination unit opposed to the photosensitive body not being used for the image forming from emitting light to the photosensitive body; and a shielding member extending along the illumination unit so as to cover the illumination unit and configured to rotate about the illumination unit, the shielding member including a transmission path formed in a part of a circumferential surface in a rotating direction so as to transmit the light emitted from the illumination unit toward the photosensitive body, and being configured to transmit the light toward the photosensitive body or block the light, wherein the driving mechanism is configured to rotate the shielding member about the illumination unit, and the control unit is configured to cause the driving mechanism to rotate the shielding member opposed to the photosensitive body used for image forming to a position that allows the light to pass the transmission path, and rotate the shielding member opposed to the photosensitive body not used for the image forming to a position that restricts the light from passing the transmission path, thereby allowing the driving mechanism to perform a light emitting operation.

2. The image forming apparatus according to claim 1, wherein the illumination unit and the shielding member covering the illumination unit are located between two of the photosensitive bodies adjacent to each other, the shielding member includes two of the transmission paths that allow the light emitted from the illumination unit to reach the photosensitive bodies, the transmission paths being formed in a part of the shielding member in the rotating direction, and the control unit is configured to cause the driving mechanism to rotate the shielding member:

to a position that allows the light emitted from the illumination unit to reach the two photosensitive bodies through the transmission path, when the two photosensitive bodies are used for the image forming; and to a position that restricts the light emitted from the illumination unit from reaching the two photosensitive bodies when the two photosensitive bodies are not used for the image forming.

3. The image forming apparatus according to claim 1, wherein the illumination unit and the shielding member covering the illumination unit are located between two of the photosensitive bodies adjacent to each other, the shielding member includes two of the transmission paths to be set to a position that allows the light emitted from the illumination unit to reach both of the photosensitive bodies, or a position that allows the light emitted from the illumination unit to reach only one of the photosensitive bodies depending on the rotational position of the shielding member, the transmission paths being formed in a part of the shielding member in the rotating direction, and the control unit is configured to cause the driving mechanism to rotate the shielding member:

to a position that allows the light emitted from the illumination unit to reach the two photosensitive bodies through the transmission path, when the two photosensitive bodies are used for the image forming; and to a position that allows, when one of the two photosensitive bodies is used for the image forming and the other photosensitive body is not used for the image forming, the light emitted from the illumination unit to reach only the one of the two photosensitive bodies through the transmission path.

4. The image forming apparatus according to claim 1, wherein the driving mechanism includes:

an intermediate transfer belt that endlessly runs opposite the plurality of photosensitive bodies; and a contact control mechanism configured to cause the intermediate transfer belt to contact or move away from the photosensitive bodies, by bringing the photosensitive body used for the image forming in an image forming process, out of the plurality of photosensitive bodies, into contact with the intermediate transfer belt for forming a black image, and separating the photosensitive bodies not used for the image forming from the intermediate transfer belt, and when the contact control mechanism moves the photosensitive body not used for the image forming away from the intermediate transfer belt, the contact control mechanism rotates the shielding member such that the transmission path is deviated from the position that allows the light from the illumination unit to reach the photosensitive body not used for the image forming.

5. The image forming apparatus according to claim 4, wherein the photosensitive bodies separated from the intermediate transfer belt by the contact control mechanism are other than the photosensitive body used for forming a black image.

6. An image forming apparatus comprising:

a plurality of photosensitive bodies;

a plurality of illumination units respectively opposed to the plurality of photosensitive bodies, and each configured to emit static eliminating light onto a surface of the corresponding photosensitive body;

a light emitter that serves as light source;

a light guide unit configured to guide light from the light emitter toward the plurality of illumination units;

a driving mechanism configured to switch between allowing the illumination unit to emit light and restricting the illumination unit from emitting light, to the photosensitive body; and a control unit configured to cause the driving mechanism to perform a light emitting operation including allowing the illumination unit opposed to the photosensitive body being used for image forming to emit light to the photosensitive body, and restricting the illumination unit opposed to the photosensitive body not being used for the image forming from emitting light to the photosensitive body, wherein the illumination unit is configured so as to rotate about a rotation axis extending in the longitudinal direction, and to emit light serving as static eliminating light to a surface of the photosensitive body through a partial region of a circumferential surface of the illumination unit in a rotating direction, the driving mechanism is configured to rotate the illumination unit about the rotation axis, and the control unit is configured to cause the driving mechanism to rotate the illumination unit opposed to the photosensitive body used for the image forming to a position that allows the light to be emitted to the photosensitive body through the partial region of the circumferential surface, and rotate the illumination unit opposed to the photosensitive body not used for the image forming to a position that restricts the light from being emitted to the photosensitive body through the partial region of the circumferential surface, thereby allowing the driving mechanism to perform a light emitting operation.

7. The image forming apparatus according to claim 6, wherein the illumination unit is located between two of the photosensitive bodies adjacent to each other, the illumination unit includes two of the partial regions of the circumferential surface to be set to a position that allows the light emitted from the illumination unit to reach both of the photosensitive bodies, the partial regions being formed in a part of the illumination unit in the rotating direction, and the control unit is configured to cause the driving mechanism to rotate the illumination unit:

to a position that allows the light to be emitted to the two photosensitive bodies through the partial regions of the circumferential surface, when the two photosensitive bodies are used for the image forming; and to a position that restricts the light from being emitted to the two photosensitive bodies through the partial regions of the circumferential surface, when the two photosensitive bodies are not used for the image forming.

8. The image forming apparatus according to claim 6, wherein the illumination unit is located between two of the photosensitive bodies adjacent to each other, the illumination unit includes two of the partial regions of the circumferential surface formed in a part of the illumination unit in the rotating direction, and is configured to be set, depending on a rotational position, to a position that allows the light to be emitted to the two photosensitive bodies or a position that allows the light to be emitted to only one of the two photosensitive bodies, and the control unit is configured to cause the driving mechanism to rotate the illumination unit:

to a position that allows the light emitted from the illumination unit to reach the two photosensitive bodies when the two photosensitive bodies are used for the image forming; and to a position that allows the light emitted from the illumination unit to reach only one of the two photosensitive bodies when one of the two photosensitive bodies is used for the image forming and the other is not used for the image forming.

9. The image forming apparatus according to claim 8, further comprising a shielding member interposed between one of the partial regions of the circumferential surface of the illumination unit and the one of the photosensitive bodies so as to block the light emitted from the illumination unit, when the illumination unit is rotated to the position that allows the light emitted from the illumination unit to reach only one of the two photosensitive bodies.

10. The image forming apparatus according to claim 6, wherein the driving mechanism includes:

an intermediate transfer belt that endlessly runs opposite the plurality of photosensitive bodies; and a contact control mechanism configured to cause the intermediate transfer belt to contact or move away from the photosensitive bodies, by bringing the photosensitive body used for the image forming in an image forming process, out of the plurality of photosensitive bodies, into contact with the intermediate transfer belt for forming a black image, and separating the photosensitive bodies not used for the image forming from the intermediate transfer belt, and when the contact control mechanism moves the photosensitive body not used for the image forming away from the intermediate transfer belt, the illumination unit is rotated to the position that restricts the light from the illumination unit from reaching the photosensitive body not used for the image forming, through the partial region of the circumferential surface.

11. The image forming apparatus according to claim 9, wherein the photosensitive bodies separated from the intermediate transfer belt by the contact control mechanism are other than the photosensitive body used for forming a black image.

* * * * *